US010582578B2

(12) United States Patent
Ekbote et al.

(10) Patent No.: US 10,582,578 B2
(45) Date of Patent: Mar. 3, 2020

(54) SOLID STATE LIGHT FIXTURES HAVING VARIABLE CURRENT DIMMING AND RELATED DRIVER CIRCUITS AND METHODS

(71) Applicant: Ideal Industries Lighting LLC, Durham, NC (US)

(72) Inventors: Ashish Ekbote, Carpinteria, CA (US); Noe Gonzalez, Santa Barbara, CA (US); Robert Underwood, Santa Barbara, CA (US)

(73) Assignee: Ideal Industries Lighting LLC, Sycamore, IL (US)

( * ) Notice: Subject to any disclaimer, the term of this patent is extended or adjusted under 35 U.S.C. 154(b) by 0 days.

(21) Appl. No.: 15/425,615

(22) Filed: Feb. 6, 2017

(65) Prior Publication Data

US 2018/0227995 A1 Aug. 9, 2018

(51) Int. Cl.
*H05B 33/08* (2006.01)

(52) U.S. Cl.
CPC ..... *H05B 33/0815* (2013.01)

(58) Field of Classification Search
CPC ..... H05B 33/0809; H05B 33/0815; H05B 33/0845
USPC ..... 315/291, 307
See application file for complete search history.

(56) References Cited

U.S. PATENT DOCUMENTS 8,680,788 B2 * 3/2014 Esaki ..... H05B 33/0818 315/209 R
9,730,289 B1 8/2017 Hu et al.
2012/0112645 A1 * 5/2012 Lee ..... H05B 33/0818 315/186
2013/0193877 A1 * 8/2013 Kuo ..... H05B 33/0815 315/307
2014/0009077 A1 * 1/2014 Yoshimoto ..... H05B 33/0815 315/210
2014/0070721 A1 * 3/2014 Naruo ..... H05B 33/0851 315/224
2014/0354170 A1 * 12/2014 Gredler ..... H05B 33/0815 315/224
2016/0044755 A1 * 2/2016 Yu ..... H05B 33/0818 315/200 R
2016/0212815 A1 * 7/2016 Watanabe ..... H05B 33/0845
2018/0035501 A1 * 2/2018 Motomura ..... H02M 1/42
2018/0376557 A1 * 12/2018 Beij ..... H05B 33/0812

OTHER PUBLICATIONS

Daniel Meeks, Loop Stability Analysis of Voltage Mode Buck Regulator With Different Output Capacitor Types—Continuous and Discontinuous Modes, Texas Instruments, Application Report SLVA30—Apr. 2008.
"Digital Three String Driver Software Specification" (19 pages) (Date Unknown but Admitted Prior Art).

* cited by examiner

*Primary Examiner* — Tung X Le
(74) *Attorney, Agent, or Firm* — Myers Bigel, P.A.

(57) ABSTRACT

A solid state light fixture includes a light emitting diode (LED) load and a driver circuit that is configured to supply a drive current to the LED load. The driver circuit may include a current supply module that is configured to reduce a drive current level during dimming of the solid state light fixture, where the current supply module is configured to operate in both a continuous conduction mode at a first dimming level and a discontinuous conduction mode at a second dimming level that is lower than the first dimming level.

21 Claims, 10 Drawing Sheets

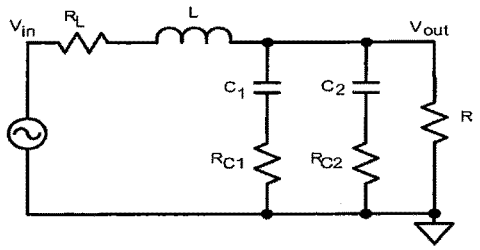

$$H_{Filter-CCM}(s) = \frac{1 + (R_{C1}C_1 + R_{C2}C_2)s + (R_{C2}C_2R_{C1}C_1)s^2}{1 + a_1 s + a_2 s^2 + a_3 s^3}$$

$$where \quad a_1 = \frac{L}{R} + (R_{C1}C_1 + R_{C2}C_2) + \frac{R_L}{R}(C_1 + C_2)$$

$$a_2 = [L(C_1 + C_2) + R_L C_1 C_2 (R_{C1} + R_{C2}) + R_{C2}R_{C1}C_2C_1] + \frac{L}{R}(R_{C1}C_1 + R_{C2}C_2)$$

$$a_3 = \frac{L}{R} C_1 C_2 [R(R_{C1} + R_{C2}) + R_{C1} R_{C2}]$$

FIG. 4A

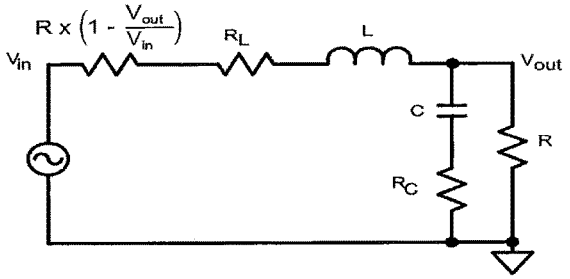

$$H_{Filter-DCM}(s) = \frac{1 + s \quad R_C \cdot C}{1 + a_1 \cdot s + a_2 \quad s^2}$$

where $$a_1 = \frac{\frac{L}{R} + RC\left(1 - \frac{V_{out}}{V_{in}}\right) + C(R_C + R_L)}{2 - \frac{V_{out}}{V_{in}}}$$

$$a_2 = \frac{LC}{\left(2 - \frac{V_{out}}{V_{in}}\right)}$$

FIG. 4B

SOLID STATE LIGHT FIXTURES HAVING VARIABLE CURRENT DIMMING AND RELATED DRIVER CIRCUITS AND METHODS

FIELD OF INVENTION

The present application generally relates to solid state light fixtures, and more particularly, to dimmable solid state light fixtures and related driver circuits and methods.

BACKGROUND

A light-emitting diode (LED) is a solid state semiconductor device that includes one or more p-n junctions. LEDs emit light when current flows through the p-n junctions thereof. Blue light emitting LEDs are in wide use today and are typically formed by growing Group III-nitride semiconductor layers (e.g., gallium nitride based layers) on a silicon carbide, sapphire or gallium nitride substrate. The brightness and energy efficiency of the light emitted by an LED may be directly related to the amount of an operating or "drive" current that flows through the p-n junction of the LED. Typically, an LED is designed to operate at a drive current level that provides both high brightness and high energy efficiency.

Most LEDs are nearly monochromatic light sources that appear to emit light having a single color. Thus, the spectral power distribution of the light emitted by most LEDs is tightly centered about a "peak" wavelength, which is the single wavelength where the spectral power distribution of the LED reaches its maximum as detected by a photodetector. The "width" of the spectral power distribution of most LEDs is between about 10 nm and 30 nm, where the width is measured at half the maximum illumination on each side of the peak of the spectral power distribution (this width is referred to as the "full-width-half-maximum" width).

In order to use LEDs to generate white light, LED-based light emitting devices have been provided that include several LEDs that each emit a light of a different color. The different colored light emitted by the LEDs combine to produce white light. For example, by simultaneously energizing red, green and blue LEDs, the resulting combined light may appear white, or nearly white, depending on, for example, the relative intensities, peak wavelengths and spectral power distributions of the red, green and blue LEDs.

White light may also be produced by coating, surrounding or otherwise associating an LED (e.g., a blue or ultraviolet light emitting LED) with one or more phosphors that convert some of the light emitted by the LED to light of one or more other colors. For example, a white light emitting LED package may be formed by coating a gallium nitride-based blue LED (i.e., an LED that emits blue light) with a "yellow" phosphor (i.e., a phosphor that emits light having a peak wavelength in the yellow color range) such as a cerium-doped yttrium aluminum garnet phosphor, which has the chemical formula $Y_3Al_5O_{12}$:Ce (YAG:Ce). The combination of the light emitted by the blue LED that is not converted by the phosphor and the green, yellow and orange light that is emitted by the broad-spectrum YAG:Ce phosphor may be perceived by a human observer as white or near-white light. The term "phosphor" is used broadly herein to refer to a material that absorbs light in a first wavelength range and in response thereto emits light in another wavelength range (typically longer wavelengths). Typically, particles of a phosphor are mixed into a binder material such as, for example, an epoxy-based or silicone-based curable resin, and this mixture is then coated, sprayed or poured onto an LED and/or another surface of a light fixture. Herein, such phosphor-including mixtures are referred to as a "recipient luminophoric medium."

Initially, LEDs were primarily used in specialty lighting applications such as providing back-lighting and/or indicator lights in electronic devices. As the light output and energy efficiency of LEDs has improved, LEDs have been used to form solid state light fixtures such as LED-based light bulbs, downlights, ceiling mounted "troffer" light fixtures that are used as replacement for conventional fluorescent light fixtures, streetlights and the like. As used herein, the term "solid state light fixture" refers to a packaged lamp, light bulb or other light fixture that includes a plurality of LEDs.

Solid state light fixtures generate less heat, are far more energy efficient and have far longer lifetime as compared to incandescent light bulbs. Solid state light fixtures also exhibit numerous advantages over fluorescent light bulbs, including better energy efficiency, faster turn-on and longer lifetimes. Solid state light fixtures may also generate more aesthetically pleasing light than fluorescent light bulbs, and do not contain mercury. Because of these advantages, solid state light fixtures are increasingly replacing conventional incandescent and fluorescent light bulbs in numerous applications including general illumination applications such as lighting for homes and offices. As solid state light fixtures are used in a much wider array of applications, the ability to efficiently and effectively dim solid state light fixtures (i.e., reduce the overall output or "brightness" of the emitted light) has arisen as an issue as consumers expect many different types of light fixtures to have dimming capabilities.

SUMMARY

Pursuant to embodiments of the present invention, solid state light fixtures are provided that include a light emitting diode (LED) load and a driver circuit that is configured to supply a drive current to the LED load. The driver circuit may include a current supply module that is configured to reduce a drive current level during dimming of the solid state light fixture. The current supply module may be configured to operate in both a continuous conduction mode at a first dimming level and a discontinuous conduction mode at a second dimming level that has a lower light output than the first dimming level.

In some embodiments, the driver circuit may further include a controller that includes a digital compensator.

In some embodiments, the digital compensator may be configured to apply gain coefficients to an error signal that is indicative of a difference in the drive current level from a reference drive current level.

In some embodiments, the digital compensator may be configured to apply a first set of gain coefficients when operating at a first operating condition and to apply a second set of gain coefficients when operating at a second operating condition. In such embodiments, the first set of gain coefficients may be used for at least some drive current levels where the current supply module operates in the continuous conduction mode and the second set of gain coefficients may be used for at least some drive current levels where the current supply module operates in the discontinuous conduction mode.

In some embodiments, the first set of gain coefficients may be used for at least some drive current levels where the current supply module operates in the continuous conduction mode and for at least some drive current levels where the current supply module operates in the discontinuous conduction mode, and the second set of gain coefficients may be used for drive current levels where the current supply module operates in the discontinuous conduction mode that are lower than the drive current levels where the first set of gain coefficients are used.

In some embodiments, the LED load may comprise a first string of LEDs and the current supply module may comprise a first current supply module, and the solid state light fixture may further include a second string of LEDs. In such embodiments, the driver circuit may further include a second current supply module that is configured to supply a drive current to the second string of LEDs, and the drive current supplied to the first string of LEDs may be reduced by a different percentage than the drive current supplied to the second string of LEDs during dimming to substantially maintain a color point of the light emitted by the solid state light fixture during dimming In some embodiments, the solid state light fixture may further include a third string of LEDs and the driver circuit may further include a third current supply module that is configured to supply a drive current to the third string of LEDs. In such embodiments, the drive current supplied to the third string of LEDs may be reduced by the same percentage as the drive current supplied to the second string of LEDs during dimming In such embodiments, the first string of LEDs may comprise a string of blue-shifted-red LEDs.

In some embodiments, the LED load may comprises a string of blue-shifted-red LED packages and the solid state light fixture may further include a plurality of blue-shifted-yellow/green LED packages. In such embodiments, the blue-shifted-yellow/green LED packages may include low-phosphor LED packages and high phosphor LED packages, the high phosphor LED packages having a higher phosphor conversion ratio than the low phosphor LED packages. The blue-shifted-red LED packages may extend in a first row and a first subset of the blue-shifted-yellow/green LED packages may extend in a second row on a first side of the blue-shifted-red LED packages and a second subset of the blue-shifted-yellow/green LED packages may extend in a third row on a second side of the blue-shifted-red LED packages that is opposite the first side. The blue-shifted-yellow/green LED packages in the second row may comprise the low-phosphor LED packages and the blue-shifted-yellow/green LED packages in the third row may comprise the high-phosphor LED packages in some embodiments.

In some embodiments, the current supply module may comprise a buck converter. In these embodiments the driver circuit may further include a rectifier circuit that is configured to rectify an input alternating current voltage and a boost power factor correction converter that is coupled to an output of the rectifier, and the buck converter may be coupled to an output of the boost power factor correction converter.

In some embodiments, the current supply module may comprise a boost converter.

In some embodiments, the driver circuit may be further configured to apply an offset that adjusts the drive current to account for errors in a sensed level of the drive current.

Pursuant to further embodiments of the present invention, solid state light fixtures are provided that include a light emitting diode (LED) load and a driver circuit that is configured to supply a drive current to the LED load. The driver circuit may include a current supply module that is configured to reduce a level of the drive current during dimming of the solid state light fixture and a controller that controls operation of the current supply module. The controller may include a digital compensator that is configured to apply gain coefficients to an error signal that represents a difference in a level of the drive current from a reference drive current level. The controller may also be configured to use a first set of gain coefficients when operating at a first operating condition and to use a second set of gain coefficients when operating at a second operating condition.

In some embodiments, the current supply module may be configured to operate in both a continuous conduction mode at a first dimming level and a discontinuous conduction mode at a second dimming level that has a lower light output than the first dimming level.

In some embodiments, the first set of gain coefficients may be used for at least some drive current levels where the current supply module operates in the continuous conduction mode and the second set of gain coefficients may be used for at least some operating current levels where the current supply module operates in the discontinuous conduction mode.

In some embodiments, the first set of gain coefficients may be used for at least some drive current levels where the current supply module operates in the continuous conduction mode and for at least some drive current levels where the current supply module operates in the discontinuous conduction mode, and the second set of gain coefficients may be used for drive current levels where the current supply module operates in the discontinuous conduction mode that are lower than the drive current levels where the first set of gain coefficients are used.

In some embodiments, the driver circuit may further be configured to apply an offset that adjusts the drive current to account for errors in a sensed level of the drive current.

In some embodiments, the LED load may comprise a first string of LEDs and the current supply module may comprise a first current supply module, and the solid state light fixture may further include a second string of LEDs. The driver circuit may further include a second current supply module that is configured to supply a drive current to the second string of LEDs, and the drive current supplied to the first string of LEDs may be reduced by a different percentage than the drive current supplied to the second string of LEDs during dimming to substantially maintain a color point of the light emitted by the solid state light fixture during dimming In some embodiments, the current supply module may be a buck converter or a boost converter.

In some embodiments, at least one gain coefficient in the second set of gain coefficients may be larger than a corresponding gain coefficient in the first set of gain coefficients.

In some embodiments, the LED load may comprise a string of blue-shifted-red LED packages, the solid state light fixture may further include a first string of blue-shifted-yellow/green LED packages, the current supply module may comprise a first converter that is configured to supply the drive current to the string of blue-shifted-red LED packages and the solid state light fixture may further include a second converter that configured to supply the drive current to the first string of blue-shifted-yellow/green LED packages. In such embodiments, the solid state light fixture may further include a second string of blue-shifted-yellow/green LED packages, where the first string of blue-shifted-yellow/green LED packages comprises blue-shifted-yellow/green LED packages including a first amount of a first phosphor and the second string of blue-shifted-yellow/green LED packages comprises blue-shifted-yellow/green LED packages including a second amount of the first phosphor that is more than the first amount. In some embodiments, the blue-shifted-red LED packages may extend in a first row, the first string of blue-shifted-yellow/green LED packages may extend in a second row on a first side of the blue-shifted-red LED packages and the second string of blue-shifted-yellow/green LED packages may extend in a third row on a second side of the blue-shifted-red LED packages that is opposite the first side.

Pursuant to further embodiments of the present invention, methods of dimming a solid state light fixture having a plurality of strings of light emitting diodes ("LEDs") are provided. Pursuant to these methods, respective drive currents are supplied to each of the plurality of strings of LEDs. A dimming control signal is received. The levels of the respective drive currents that are supplied to the respective strings of LEDs are adjusted in response to the dimming control signal, where the drive current supplied to a first of the LED strings is adjusted on a percentage basis differently than the drive current supplied to a second of the LED strings to account for changes in a color point of the light emitted by the solid state light fixture during dimming due to changes in the peak wavelength and emission spectra of the LEDs in the strings of LEDs that arise as the level of the respective drive currents are reduced in response to the dimming control signal.

In some embodiments, the plurality of strings of LEDs may include a string of blue-shifted-red LEDs and a string of blue-shifted-yellow/green LEDs, and the level of the drive current supplied to the string of blue-shifted-red LEDs may be adjusted based both on an amount of dimming specified by the dimming control signal and to account for the changes in the color point of the light emitted by the solid state light fixture during dimming, while the level of the drive current supplied to the string of blue-shifted-yellow/green LEDs may be adjusted based on only the amount of dimming specified in the dimming control signal.

In some embodiments, the solid state light fixture may be configured to have an adjustable color point that may be set to a set color point, and the solid state light fixture may substantially maintain the set color point during dimming.

In some embodiments, the solid state light fixture may be configured to emit light having a correlated color temperature of less than 4000 K and the level of the drive current that is supplied to the string of blue-shifted-red LEDs may be reduced on a percentage basis more than the level of the drive current supplied to the string of blue-shifted-yellow/green LEDs.

In some embodiments, the solid state light fixture may be configured to emit light having a correlated color temperature of more than 4000 K and the level of the drive current that is supplied to the string of blue-shifted-red LEDs may be reduced on a percentage basis less than the level of the drive current supplied to the string of blue-shifted-yellow/green LEDs.

Pursuant to still further embodiments of the present invention, methods of calibrating a driver circuit for a solid state light fixture that includes a light emitting diode (LED) load are provided. Pursuant to these methods, the driver circuit is set so that it does not supply a drive current to the LED load. Then, a level of the drive current that is supplied to the LED load is sensed. The sensed level of the drive current is then recorded as a zero offset of a current sensing circuit of the driver circuit.

In some embodiments, the solid state light fixture may be configured to automatically sense the level of the drive current that is supplied to the LED load when the driver circuit to not supply a drive current to the LED load and to record the sensed level of the drive current as a zero offset of a current sensing circuit of the driver circuit on a periodic or non-periodic basis.

In some embodiments, the drive current supplied to the LED load may be adjusted based on the recorded zero offset when the driver circuit supplies a drive current to the LED load.

BRIEF DESCRIPTION OF THE FIGURES

FIGS. 4A and 4B are circuit diagrams of the equivalent filter responses of a buck converter operating in continuous conduction mode and discontinuous current mode, respectively.

DETAILED DESCRIPTION

Figure 1A:
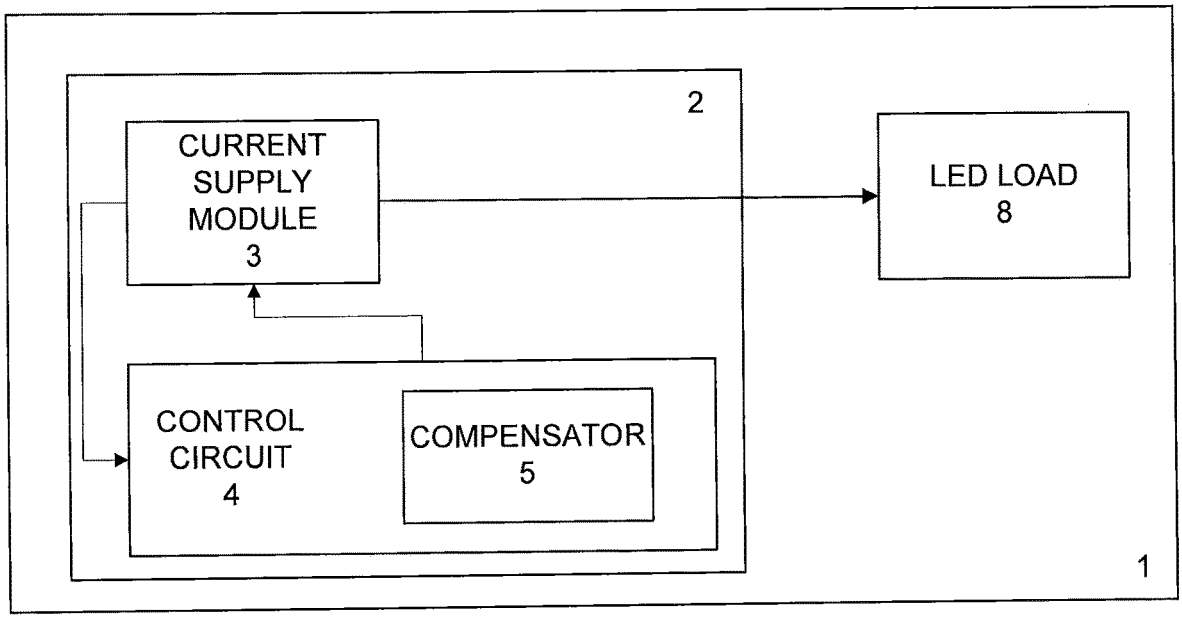
FIG. 1A is a schematic block diagram of a dimmable solid state light fixture according to embodiments of the present invention.

Solid state light fixtures include one or more driver circuits that supply an operating or "drive" current to the LEDs thereof. Conventional high-power driver circuits for solid state light fixtures have current regulation stages that are configured to operate in a switching mode in order to reduce power loss and improve efficiency. As noted above, in many applications, it may be desirable to be able to dim the light output by a solid state light fixture. In order to perform such dimming, pulse width modulation dimming is often used. With pulse width modulation dimming, the drive current flowing through an LED load of the solid state light fixture may be maintained at its normal peak value (i.e., the value during non-dimming operations). A duty cycle is applied so that the drive current is supplied to the LED load as a pulsed signal. During a first portion of each cycle, the drive current is supplied to the LED load, and then the drive current is cut off during the second portion of each cycle (except perhaps for current supplied by one or more inductive elements). In this fashion, the peak current supplied to the LED load may be maintained constant, but the average current is reduced. The amount of dimming applied may be controlled by varying the duty cycle of the pulses (i.e., the percentages of each cycle during which the drive current is and is not supplied to the LED load).

Pulse width modulation dimming thus maintains the drive current supplied to the LED load at its peak level. However, when low or ultra-low dimming is performed, the duty cycle for the pulse width modulation is drastically reduced, resulting in very large "off" times where no current is supplied to the LED load that are interrupted by very short "on" periods (e.g., as small as 1/100th of each cycle or less) where the drive current is supplied to the LED load. Unfortunately, due to the long "off" periods in the duty cycle that are necessary to achieve ultra-low dimming, undesired flickering or shimmering may result when pulse width modulation dimming is used. Such flickering or shimmering may cause banding or rolling lines in images and/or videos captured by cameras due to incompatibility between the refresh rates of the camera and the frequency of the pulse width modulation dimming The amount of flickering and/or shimmering may be reduced by using a large electrolytic capacitor in the drive circuit. However, the use of such large electrolytic capacitors may be impractical in many applications due to cost and/or size constraints, lifetime requirements and/or because the response time of the capacitor may be inadequate. Instead of using a large capacitor to address the problem of flicker during ultra-low dimming, the frequency of the pulse width modulation of the drive current may be increased in order to reduce the length of each "off" cycle. However, the use of high frequency pulse width modulation may be undesirable because, when ultra-low dimming is needed, the time for the driver circuitry to operate may become too short for the LED drive current to be regulated as desired due to the response time of the driver circuitry.

Variable current dimming (also referred to herein as "linear" dimming) has also been used in solid state light fixtures. With this approach, the driver circuit reduces the level of the current that is supplied to the LED load to accomplish dimming. During normal (i.e., non-dimmed) operation, the current supplied to the LED load can be very high, such as, for example, a current of 1.5 A for power LEDs. Reducing the level of the drive current supplied to the LED load generally does not raise issues for moderate levels of dimming However, when very low dimming is required, it may become necessary to regulate very small LED drive currents (e.g., 1.5 mA if dimming to 0.1% a 1.5 A current level). In order to measure such small current levels as part of the current regulation process, it may be necessary to use relatively large resistors. Unfortunately, during non-dimming and moderate dimming operations, these large resistors may exhibit high power loss. If lower resistor values are used to reduce the power loss, it may become difficult to accurately measure the drive current during ultra-low dimming operations, which may make it difficult for the driver circuitry to achieve stable regulation of the drive current supplied to the LED load under such operating conditions.

Pursuant to embodiments of the present invention, dimmable solid state light fixtures are provided, along with related driver circuits that may be used in, or in conjunction with, these solid state light fixtures. The driver circuits according to various embodiments incorporate variable current dimming capabilities into a current supply module that supplies a drive current to the LED load such as, for example, a buck converter or a boost converter. The driver circuits can provide high power efficiency and may perform dimming over a wide range (i.e., to very low light output levels).

In some embodiments, the current supply module may be configured to operate in either a continuous conduction mode or a discontinuous conduction mode depending upon the amount of dimming required. In such embodiments, the current supply module of the driver circuit may include a digital compensator and may be configured so that the gain coefficients of the digital compensator may be changed. As a result, the gain coefficients for the digital compensator that are used for at least a portion of the drive current levels corresponding to the continuous conduction mode are different than the gain coefficients that are used for at least a portion of the drive current levels corresponding to the discontinuous conduction mode.

In some embodiments, the solid state light fixture may include at least a first string of LED packages that emit a first color light and at least one second string of LED packages that emit a second color light that is different from the first color. For example, the at least one first string may be so-called blue-shifted-yellow/green LED packages and the at least one second string may be so-called blue-shifted-red LED packages. A blue-shifted-yellow/green LED package refers to a blue LED having an associated phosphor that emits light having a peak wavelength in either the green or yellow color ranges, and a blue-shifted-red LED package refers to blue LED having an associated phosphor that emits light having a peak wavelength in the red color range. The level of the drive currents that are supplied to the LED strings included in the solid state light fixture may be adjusted to account for changes in the color point of the light emitted by the solid state light fixture that may occur during dimming, since the reduction in the current level during dimming may affect the peak wavelength and/or the full width half maximum width of the light emitted by the LEDs.

In some embodiments, the current level of at least one LED string that includes blue-shifted-red LEDs may be adjusted to maintain a color point of the emitted light during dimming. As known to those of skill in the art, the "color point" of emitted light refers to the color of the light as defined by a pair of coordinates on a chromaticity diagram such as, for example, the 1931 Chromaticity diagram. For a discussion of the color point of light emitted by a solid state light fixture, see U.S. patent application Ser. No. 15/226,992, filed Aug. 3, 2016, the entire content of which is incorporated herein by reference. The relative adjustments to the drive currents that are supplied to the LED strings may be accomplished in firmware of the current supply module based on empirically obtained results in some embodiments.

Embodiments of the present invention will now be discussed in further detail with reference to the accompanying drawings.

FIG. 1A is a schematic block diagram of a dimmable solid state light fixture 1 according to embodiments of the present invention. As shown in FIG. 1A, the dimmable solid state light fixture 1 includes a driver circuit 2 and an LED load 8.

The LED load 8 may comprise, for example, one or more LEDs (not shown). When multiple LEDs are provided, the LEDs may be arranged in series or in parallel or a combination thereof.

As shown in FIG. 1A, the driver circuit 2 includes a current supply module 3. In some embodiments, the current supply module 3 may be configured to adjust a level of the drive current that is supplied to the LED load 8 in response to a dimming control signal in order to dim the light output by the LED load 8. In some embodiments, the current supply module 3 may be a power converter such as, for example, a buck converter or a boost converter, that operate in both a continuous conduction mode of operation and a discontinuous conduction mode of operation. It will be appreciated, however, that any appropriate current supply module 3 may be used including the aforementioned buck and boost converters, flyback converters, power factor correction converters, single-ended primary inductor converters, and combinations of different converters (e.g., a buck-boost converter, a boost-buck converter, etc.). In some embodiments, the current supply module 3 may be configured to operate in a continuous conduction mode of operation, a discontinuous conduction mode of operation, and/or a transition mode of operation that is between the continuous and discontinuous conduction modes of operation.

The driver circuit 2 further includes a control circuit 4 that is configured to control operations of the current supply module 3 both during dimming and non-dimming operations. The driver circuit 2 further includes a compensator 5. As shown in FIG. 1A, in some embodiments, the compensator 5 may be part of the control circuit 4. The compensator 5 may be configured to apply gain coefficients to an error signal that is proportional to the drive current that is supplied to the LED load 8. In some embodiments, the compensator 5 may be a digital compensator, although it will be appreciated that analog embodiments could also be used.

In some embodiments, a first set of gain coefficients may be applied by the digital compensator 5 when the drive current that is supplied to the LED load 8 is in a first range and a second set of gain coefficients may be applied by the digital compensator 5 when the drive current that is supplied to the LED load 8 is in a second range. Moreover, more than two sets of gain coefficients may be used. In an example embodiment, the first set of gain coefficients may be used when the current supply module 3 is operating in the continuous conduction mode of operation at a drive current level above a first value $A_1$, and the second set of gain coefficients may be used when the current supply module 3 is operating in the continuous conduction mode of operation at a drive current level at or below the first value $A_1$, and may also be used for at least some range of drive current values when the current supply module 3 is operating in the discontinuous conduction mode of operation. A third set of gain coefficients may be used when the current supply module 3 is operating in the discontinuous conduction mode of operation at very low current levels, and a fourth set of gain coefficients may be used in some embodiments when the current supply module 3 is operating in the continuous conduction mode of operation at high drive current levels. More or less sets of gain coefficients may be used in other embodiments.

The control circuit 4 may further include an amplifier (not shown). The amplifier may amplify a signal that represents the current flowing through the LED load 8. An output of the amplifier may be coupled to the compensator 5. An example embodiment of such an arrangement is discussed in greater detail below with reference to FIG. 2.

In some embodiments, the LED load 8 may be a single string of LEDs where each LED in the string emits the same color light. Alternatively, the LED load 8 may be a single string of LEDs where at least two of the LEDs in the string emit light having different colors. It will likewise be appreciated that the solid state light fixture 1 may include multiple strings of LEDs. In such embodiments, a single current supply module 3 could provide a drive current to the multiple strings of LEDs. In other embodiments, multiple current supply modules 3 may be provided with each current supply module 3 providing a drive current to a respective one of the multiple LED strings. A first of the multiple LED strings could only include first LEDs that each emit the same color light, and a second of the multiple LED strings could only include second LEDs that each emit the same color light, albeit a different color than the first LEDs. In other embodiments, the first and/or the second of the multiple LED strings may include LEDs that emit different color light.

Figure 1B:
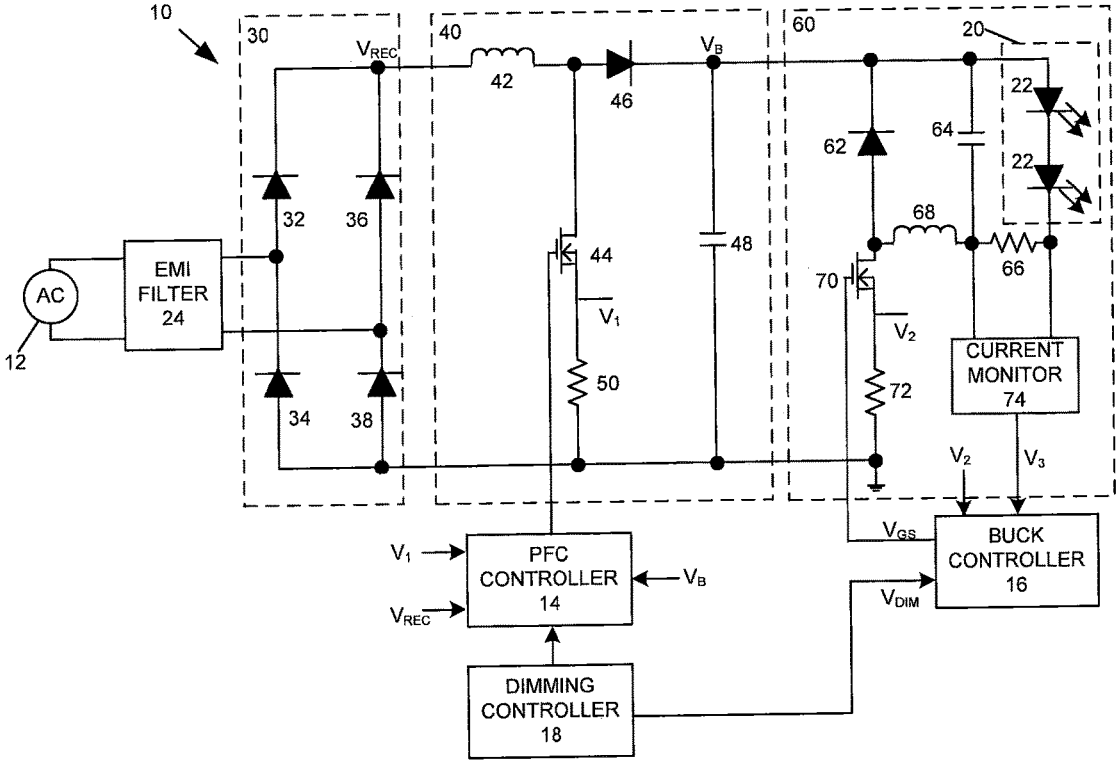
FIG. 1B is a circuit diagram of a driver circuit for a dimmable solid state light fixture according to certain embodiments of the present invention.

FIG. 1B is a circuit diagram of a driver circuit 10 for a solid state light fixture according to embodiments of the present invention. The driver circuit 10 is one example implementation of the driver circuit 2 of FIG. 1A, where the driver circuit 10 includes a buck converter that is used to implement the current supply module 3 of FIG. 1A.

As shown in FIG. 1B, the driver circuit 10 includes an alternating current (AC) voltage source 12, a boost power factor correction (PFC) controller 14, a buck controller 16 and a dimming controller 18. The driver circuit 10 further includes an EMI filter 24, a bridge rectifier 30, a boost PFC converter 40, and a DC-to-DC buck converter 60. The driver circuit 10 supplies a drive current to an LED load 20, which is exemplarily illustrated in FIG. 1B as comprising a pair of LEDs 22 that are disposed in series. While the LED load 20 is illustrated in FIG. 1B to facilitate explanation of the operation of the driver circuit 10, it will be appreciated that the LEDs 22 that form the LED load 20 are not part of the driver circuit 10 but instead comprise the load that is driven by the driver circuit 10 (i.e., LED load 20 corresponds to LED load 8 of FIG. 1A).

The AC voltage source 12 may comprise, for example, a standard 120 V wall outlet. It will be appreciated, however, that a wide variety of AC voltage sources 12 may be used such as, for example, AC voltage sources that output AC voltages in the range of 100 V to 277 V or higher. The driver circuit 10 converts the AC voltage input from the AC voltage source 12 into a voltage that is suitable for powering the LED load 20. The driver circuit 10 may also be used to dim the light output by the LED load 20.

The EMI filter 24 is used to filter out high frequency noise that may be present on the AC power output from the AC voltage source 12 and noise generated by the driver circuit 10. The EMI filter 24 may, for example, divert high frequency noise components that are carried on the conductors of the AC voltage source 12 to ground. EMI filters are well known in the art and hence further description thereof will be omitted here.

The bridge rectifier circuit 30 comprises a series of diodes 32, 34, 36, 38 that are arranged in a bridge configuration as shown in FIG. 1B. The bridge rectifier circuit 30 rectifies the AC output from the AC voltage source 12 to provide a DC voltage at the output of the bridge rectifier 30. Bridge rectifier circuits are also well known in the art and hence further description thereof will be omitted here.

The DC voltage output by the bridge rectifier circuit 30 ($V_{REC}$) is the input to the boost PFC converter 40. The boost PFC converter 40 includes an inductor 42, a switch 44, a diode 46, a capacitor 48 and a resistor 50. The boost PFC converter 40 functions as a DC-to-DC power converter that converts a DC voltage that is input from the bridge rectifier circuit 30 into a higher voltage DC voltage $V_B$ that is output from the boost PFC converter 40. As the boost PFC converter 40 steps up the voltage, the current output by the boost PFC converter 40 is necessarily reduced as compared to the input current as power (P=V*I) must be conserved.

The switch 44 may comprise, for example, a MOSFET transistor 44. The boost PFC controller 14 provides a control signal to the gate of the MOSFET 44 in order to turn the transistor on and off. When the MOSFET 44 is turned on (i.e., the switch 44 is closed), current flows through the inductor 42 in the clockwise direction and the inductor 42 stores energy by generating a magnetic field. When the MOSFET 44 is turned off (i.e., the switch 44 is opened), the only path for the current is through the flyback diode 46, and hence the capacitor 48 is charged when the MOSFET 44 is turned off. There are two modes of PFC operations, namely a continuous conduction mode and a discontinuous conduction mode. In the continuous conduction mode of operation, the switch 44 is cycled between its on and off states fast enough so that the inductor 42 does not fully discharge during each time period when the switch 44 is turned off (opened). In the discontinuous conduction mode of operation, the inductor 42 current decreases to zero (i.e., the inductor 42 is fully discharged) during each time period when the switch 44 is turned off (opened). When the switch 44 is turned off, the DC voltage $V_{REC}$ output by the bridge rectifier circuit 30 and the inductor 42 appear as two voltage sources in series which allows the capacitor 48 to be charged to a voltage higher than the DC voltage $V_{REC}$ that is output by the bridge rectifier circuit 30. When the switch 44 is closed by turning the MOSFET 44 on, the DC voltage output by the bridge rectifier circuit 30 is applied across the inductor 42 and diode 46 is reverse biased. As such, current does not flow from the bridge rectifier circuit 30 to the output of the boost PFC converter 40, and the capacitor 48 provides the voltage and current to the output of the boost PFC converter 40. The capacitor 48 is recharged the next time the switch 44 is opened in the manner described above. Thus, by controlling the frequency and/or duty cycle at which the switch 44 is turned on and off, the boost PFC controller 14 may regulate the output voltage of the boost PFC converter 40 (i.e., the voltage across capacitor 48). The boost PFC converter 40 also provides power factor correction by shaping the input current so that it follows the shape of the input AC voltage provided by the AC voltage source 12. The boost PFC converter 40 may achieve a high level of power factor correction (greater than 0.9) and low total harmonic distortion (less than 20%).

The boost PFC controller 14 may receive as inputs voltages $V_1$, $V_{REC}$ and $V_B$. Voltage $V_1$ is the voltage drop across resistor 50, which may be used to sense the current flowing through the switch 44. Voltage $V_{REC}$ is the voltage at the output of the bridge rectifier circuit 30. Voltage $V_B$ is the voltage across the output of the boost PFC converter 40. The PFC controller 14 may use these voltages to adjust the frequency and/or duty cycle at which the switch 44 is turned on and off to maintain the output voltage $V_B$ at a desired level while also achieving a high degree of power factor correction. A controller that is commercially available from ST Microelectronics (part number L6564) can be used to implement the boost PFC controller 14.

The buck converter 60 regulates the drive current supplied to the LED load 20. The DC voltage output by the boost PFC converter 40 is applied across the input to the buck converter 60. The buck converter 60 includes a diode 62, a capacitor 64, a first resistor 66, an inductor 68, a switch 70, a second resistor 72 and a current monitor 74. Other components may be included as well. The switch 70 is used to regulate the amount of drive current that is supplied to the LED load 20. The switch 70 may comprise, for example, a MOSFET transistor 70. The buck controller 16 provides a control signal $V_{GS}$ to the gate of the MOSFET 70 in order to turn the MOSFET 70 on and off. The first resistor 66 and the inductor 68 are coupled in series with output of the LED load 20, and the capacitor 64 is connected in parallel across the LED load 20.

The switch 70 is turned on and off to regulate the drive current flowing through the LED load 20. The current monitor 74 senses the current flowing through the LED load 20. The capacitor 64 maintains the voltage across the LED load relatively constant, thereby providing a relatively constant current to the LED load 20, and filters out AC components in the drive current. The diode 62 provides a current path that allows the energy stored in the inductor 68 to be released to the LED load 20.

The current monitor 74 is connected across the first resistor 66 and outputs a signal that reflects the current flowing through the LED load 20. In the depicted embodiment, the current monitor 74 outputs a voltage signal $V_3$ that reflects the voltage drop across the first resistor 66. Since the value of first resistor 66 is known, the load current can be calculated directly from the voltage drop $V_3$ via Ohms Law. The second resistor 72 is coupled between the switch 70 and a reference voltage (e.g., ground).

The buck converter 60 may operate as follows. The DC signal output by the boost PFC converter 40 provides a current to the LED load 20. The buck controller 16 regulates the current flowing through the LED load 20 using the output of an error amplifier (discussed below) that outputs a signal representing the difference between a desired current flowing through the LED load 20 and an actual current flowing through the LED load 20. The buck controller 16 outputs a signal $V_{GS}$ to the gate of the MOSFET 70 to regulate the current through the LED load 20. When the signal $V_{GS}$ that is applied to the gate of the MOSFET 70 is high, the MOSFET 70 is turned on (i.e., the switch 70 is closed) and current flows from the boost PFC converter 40 through the LED load 20, through the first resistor 66 and the inductor 68 and then through the switch 70. The inductor 68 stores energy by generating a magnetic field during such time periods. When the signal $V_{GS}$ that is applied to the gate of the MOSFET 70 is brought low, the MOSFET 70 is turned off (i.e., the switch 70 is opened) and the inductor 68 discharges through the diode 62 to maintain the current flow through the LED load 20. In a fixed switching frequency continuous conduction mode of operation, the buck controller 16 turns the switch 70 on and off based on an error signal that may, for example, be the result of a comparison of signal $V_3$ (or an amplified version thereof) to a reference voltage that reflects a desired drive current level for the LED load 20. In particular, the buck controller 16 may control the control signal $V_{GS}$ to turn the switch 70 on and off in response to the error signal. The buck controller 16 may also be operated in a so-called "transition" or "critical" mode where operation switches from continuous conduction mode to the discontinuous conduction mode, i.e., the switch 70 is turned on at the moment the current of the inductor 68 decreases to zero. The buck controller 16 may further be operated in a discontinuous conduction mode of operation. In this mode of operation, the switch 70 is not turned on until sometime after the moment the current of the inductor 68 decreases to zero. A microcontroller can be used to implement the buck controller 16.

Conventional buck converters that use pulse width modulation for dimming may omit the current monitor 74 and may instead compare the voltage $V_2$ to a reference value or signal determine the appropriate switching frequency for the switch 70 both to maintain the drive current at a desired level and for dimming operations. This may be sufficient when the buck converter 60 only operates in continuous conduction mode (or perhaps continuous conduction mode and the transition mode) as a simple relationship may exist between the drive current and the current through the switch 70 under these operating conditions. That is not necessarily the case when the buck converter 60 also must operate in discontinuous conduction mode. Consequently, in the driver circuit 10 of FIG. 1B, the drive current is sensed directly via the current monitor 74 and the sensed drive current level is fed through a feedback loop to maintain the drive current at a desired level, as will be discussed in further detail below.

The ability to dim a solid state light fixture may be very important in various applications, including general illumination and specialty lighting applications within the home. Low and/or ultra-low dimming may also be desired in some applications, either for consumer preference or so that the solid state light fixture can operate in conjunction with an internal or external sensor such as an image sensor. As noted above, the driver circuit 10 includes a dimming controller 18 that may be used to accomplish such dimming In particular, the dimming controller 18 may generate one or more control signals that control other elements of the driver circuit 10 to reduce the level of drive current flowing through the LED load 20, thereby reducing the amount of light output by the LEDs 22. The dimming controller 18 may operate in response to an external control signal. The dimming controller 18 generates a dimming control signal $V_{DIM}$ that is provided to the buck controller 16 to control the dimming operations. The dimming controller 18 may also provide a control signal to the boost PFC controller 14 that is used to enable or disable the boost PFC operation.

The buck controller 16 may control the brightness of light emitted by the LED load 20 by varying the level of the current that is supplied to the LED load in response to the control signals provided by the dimming control circuit 18. This may be accomplished, for example, by reducing a current reference (which may be, for example, a reference voltage) that is used by the buck controller 16 to determine the level of current flowing through the LED load 20.

Figure 2:
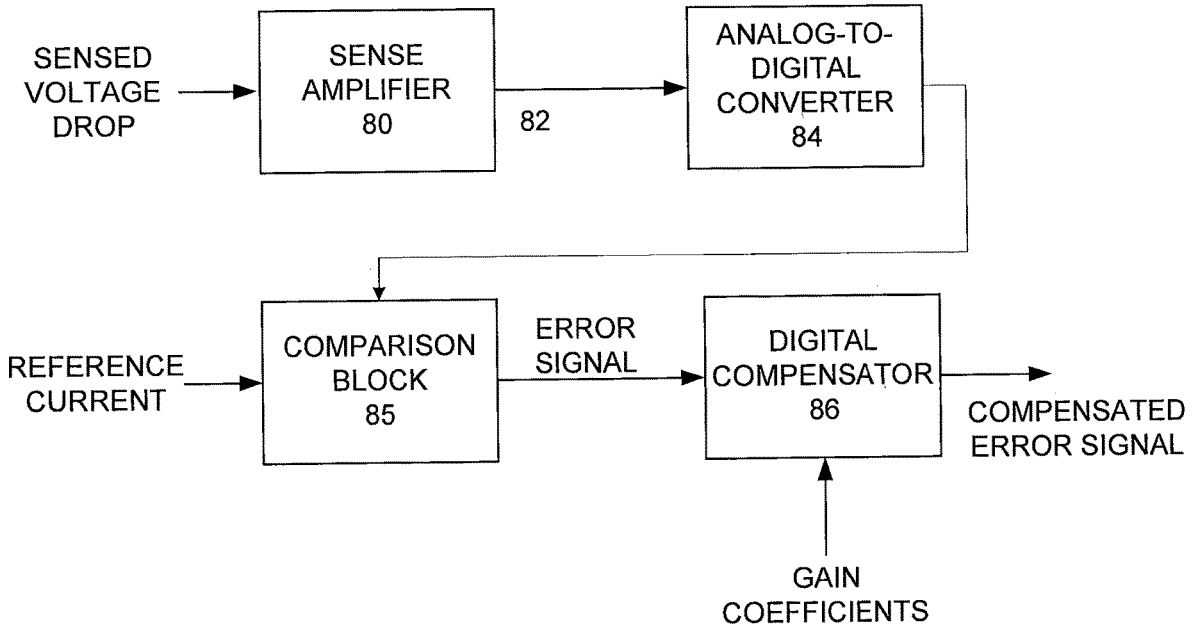
FIG. 2 is a schematic block diagram of an embodiment of current sensing and regulation circuitry that may be included in the driver circuits of FIG. 1A and/or FIG. 1B.

As described above, the voltage drop across the resistor 66 is proportional to the drive current through the LED load 20. FIG. 2 is a schematic block diagram of an embodiment of current sensing and regulation circuitry that may be included in the driver circuit 2 of FIG. 1A and/or the driver circuit 10 of FIG. 1B. The circuit of FIG. 2 may be viewed as an error amplifier that determines an error in the drive current from a desired value and provides a compensated error signal that may then be used by the current supply module 3 of FIG. 1A or the buck converter 60 of FIG. 1B to adjust the drive current level. The circuitry shown in FIG. 2 may be included, for example, in the buck controller 16 and/or the current monitor 74 of FIG. 1B.

As shown in FIG. 2, the voltage drop that is sensed across resistor 66 (see FIG. 1B) is input to a differential sense amplifier 80 that has an output 82. The output 82 of the sense amplifier 80 is fed to an input of an analog-to-digital converter 84. The analog-to-digital converter 84 digitizes the output of the sense amplifier 80. The digitized sense voltage that is output by the analog-to-digital converter 84, which is proportional to the drive current through the LED load 20, is compared to a reference value such as a reference current. As shown in FIG. 2, in an example embodiment, this comparison may be performed using a comparison block 85. The comparison block 85 may be implemented, for example, in firmware in the buck controller 16. The signal output by the comparison block 85 comprises an error signal that may represent the difference between the digitized sense voltage and the reference value. The error signal is passed through a digital compensator 86. The digital compensator 86 applies gain coefficients to the error signal to compensate for phase and gain characteristics of the buck converter 60 (see FIG. 1B) at different frequencies of interest. The digital compensator 86 may selectively filter out some frequency components of the error signal while amplifying other frequency components to improve the performance of the buck converter 60. In some embodiments, the digital compensator 86 may be implemented in whole or part in a microcontroller that is used to implement the buck controller 16.

Since the driver circuit 10 operates using variable current dimming as opposed to pulse width modulation dimming, the drive current may vary greatly based on the amount dimming. For example, in a typical embodiment the drive current may vary by a ratio of 100-to-1 or more. In other embodiments, the drive current may vary by a ratio of 200-to-1 or more. In still other embodiments, the drive current may vary by a ratio of 300-to-1 or more. As such, the buck converter 60 may operate from a full load condition to an extremely light load condition where very small currents are supplied to the LED load 20.

Because of this large range, the buck converter 60 may switch from the continuous conduction mode of operation, which will apply when no dimming or more moderate levels of dimming are applied, to the transition mode, to the discontinuous conduction mode. The characteristics of the buck converter 60 (or other current supply module) may differ based on the mode of operation. The digital compensator 86 may be used to optimize the closed loop response of the buck converter 60 over a frequency range of interest. The compensation necessary to optimize performance, however, may vary based on the drive current levels. This is particularly true at the transition point where the buck converter switches between operating in a continuous conduction mode and a discontinuous current mode.

Another potential impact of the large range of dimming in drive circuits that use variable current dimming as opposed to pulse width modulation dimming is that it may be difficult to accurately measure the drive current under ultra-low dimming conditions. This difficulty may arise because the drive current levels under these conditions may be very low and both noise in the driver circuitry as well as external noise may impact the current readings. Accordingly, it may be desirable or necessary to amplify the signal that represents the sensed drive current (note that this signal may comprise a signal that is proportional to the sensed drive current, such as a voltage) prior to comparing the signal that represents the sensed drive current to a reference value.

As noted above, the digital compensator 86 applies a transfer function to the error signal input thereto which compensates for certain gain and phase characteristics of the buck converter 60 in the frequency range of interest. Various "gain" coefficients of the transfer function may be preset to provide the appropriate compensation as a function of (1) the drive current supplied to the LED load 20 and/or (2) the mode of operation (i.e., continuous conduction mode, discontinuous conduction mode or transition mode) of the buck converter 60. Accordingly, in order to optimize the closed loop operating characteristics of the buck converter 60 (or other current supply module), the gain coefficients that are applied by the digital compensator 86 may be changed in firmware (or by other means) based on, for example, a level of the drive current, a mode of operation of the buck converter 60 or an equivalent or similar parameter or a combination of parameters. In this fashion, the drive circuit can be configured to meet design margins over the full range of operating currents.

Figure 3:
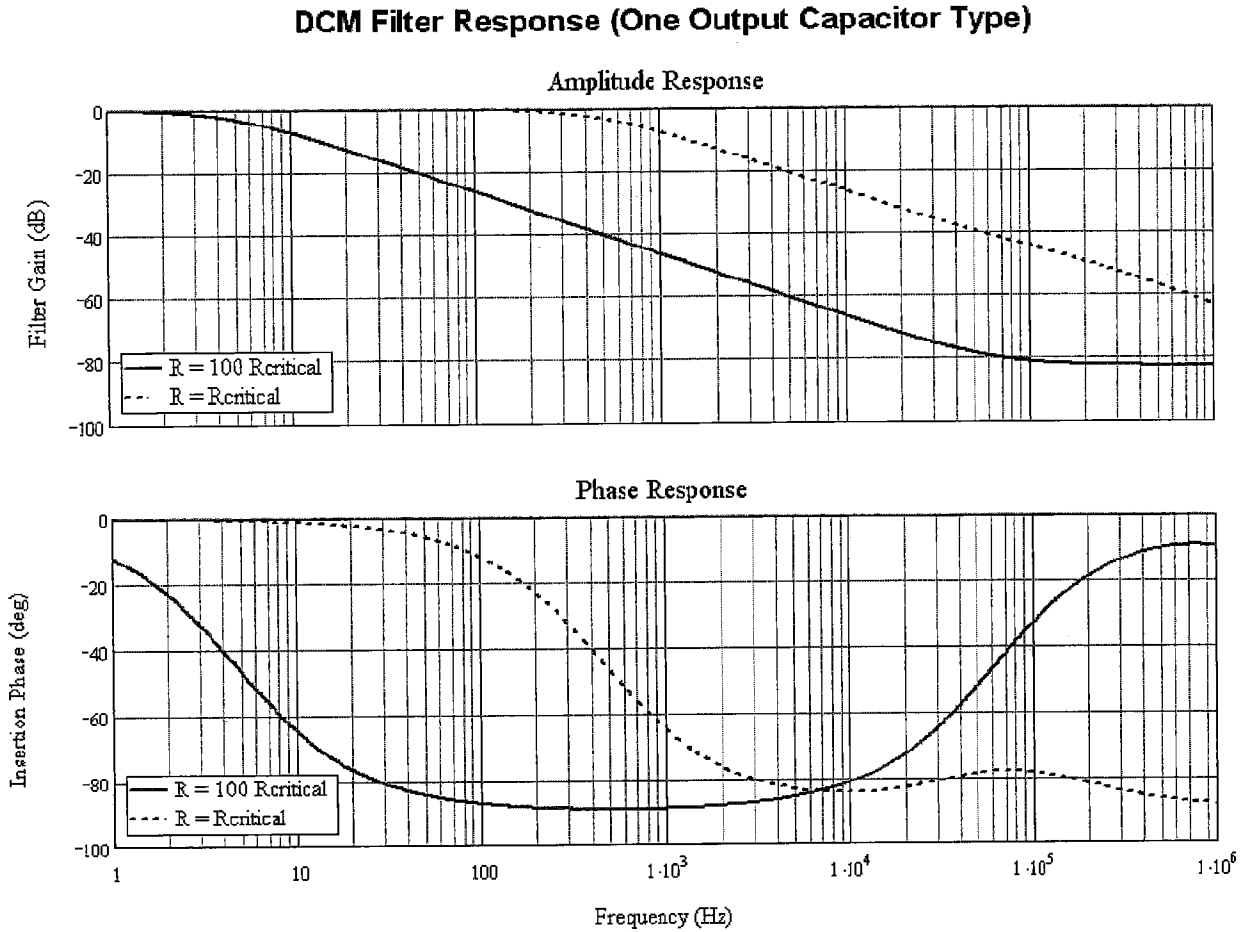
FIG. 3 is a pair of graphs showing the amplitude and phase bode plots of a buck converter in the discontinuous conduction mode and in the transition mode.

The filter transfer function of a buck converter in continuous conduction mode differs from the filter transfer function of the same buck converter operating in discontinuous conduction mode, as is explained, for example, in an Application Report by Texas Instruments titled *Loop Stability Analysis of Voltage Mode Buck Regulator with Different Output Capacitor Types—Continuous and Discontinuous Modes*. The same may be true of various other current supply circuits. FIGS. 3A and 3B are amplitude and phase bode plots, respectively, that illustrate the filter characteristics of an example buck converter in the discontinuous conduction, mode (the plot labelled $R=100*R_{Critical}$) and in the transition mode where operation switches from continuous to discontinuous conduction mode (the plot labelled $R=R_{critical}$). As shown in FIGS. 3A and 3B, both the gain and the bandwidth are greatly reduced as the buck converter goes deep into discontinuous current mode. When this occurs, the buck converter does not respond well to transients and other noise and may not operate within design margins. By adjusting the gain coefficients in the digital compensator 86, the filter response of the buck converter 60 may be improved and brought back within design margins.

In some embodiments of the present invention, the buck converter 60 (or other current supply module) may be designed to primarily operate in continuous conduction mode (i.e., the buck converter 60 will operate in the continuous conduction mode for most drive current levels). However, at low drive current levels, the buck converter 60 may enter into the discontinuous conduction mode of operation. The threshold drive current level where this transition occurs can be determined during the design phase for the buck converter 60 and may be a function of the voltage applied at the input to the buck converter 60, the inductance of inductor 68, the switching frequency of switch 70 and/or the drive current supplied to the LED load 20. Thus, assuming worst case operating conditions, the drive current level that corresponds to the transition point where the buck converter 60 will switch between the continuous conduction mode of operation and the discontinuous conduction mode of operation may be determined.

In some embodiments of the present invention, firmware in the buck controller 16 may be programmed to monitor the drive current that is supplied to the LED load 20 (as determined, for example, by current monitor 74). When the drive current falls below a pre-selected value, the gain coefficients applied by the digital compensator 86 may be changed (e.g., increased) in order to increase the bandwidth of the buck converter 60 at these low drive current levels. Depending upon the desired margins, the range of drive current levels and the design of the driver circuit 10 it may be desirable to use more than two sets of gain coefficients in the digital compensator 86. For example, in one embodiment, three or more sets of different gain coefficients may be used with each set of gain coefficients applied for a different range of drive current levels. In an example of such an embodiment, a first set of gain coefficients may be used when the buck converter 60 is operating in continuous conduction mode at drive current levels above a first value $A_1$, a second set of gain coefficients may be used when the buck converter 60 is operating in continuous conduction mode at drive current levels at or below the first value $A_1$ and for drive current levels above a second value $A_2$ when the buck converter 60 is operating in discontinuous conduction mode, and a third set of gain coefficients may be used when the buck converter 60 is operating in discontinuous conduction mode at drive current levels at or below the second value $A_2$.

Applicants note that a driver circuit that includes a buck converter having a digital compensator with adjustable gain coefficients is known in the art. In particular, the drive circuit for the CR troffer available from Cree, Inc. of Durham, N.C. includes a buck converter with a digital compensator with gain coefficients that change. However, this drive circuit only operates in continuous conduction mode and uses pulse width modulation as opposed to variable current dimming. In the CR troffer, the gain coefficients were lowered to account for situations where a very high drive current was supplied to the LED load.

The filter characteristics of the buck converter 60 may somewhat abruptly change at the drive current level that corresponds to the transition point where the buck converter 60 switches from the continuous conduction mode of operation to the discontinuous conduction mode of operation. This drive current level may, therefore, represent a natural point for changing the gain coefficients that are applied by the digital compensator 86. Some driver circuits according to embodiments of the present invention may be designed to change the gain coefficients at drive current levels that substantially correspond to this transition point. However, it has been discovered that in some cases it may be advantageous to change the gain coefficients at a drive current level where the buck converter 60 is still operating in the continuous conduction mode of operation, albeit the drive current level is somewhat close to the transition point. As noted above, the gain coefficients may also be changed again when the solid state light fixture is deep into the discontinuous conduction mode of operation (i.e., during very deep dimming), and/or may also be changed under non-dimming operations and/or at very light levels of dimming.

In some embodiments, the gain coefficients that will ensure a desired performance level for the buck converter 60 at various different drive current levels may be determined empirically and may then be optimized by making bode measurements of the loop for different drive current levels. Alternatively, a filter transfer function of the inverse buck can be modelled and an appropriate digital compensator 86 may then be designed with different gain coefficients for different ranges of drive current levels. FIGS. 4A and 4B illustrate the equivalent filters for the buck compensator 60 in continuous conduction mode and discontinuous conduction mode, respectively. The corresponding transfer functions of these filters are also provided in FIGS. 4A and 4B, respectively. The gain coefficients $a_1$, $a_2$, $a_3$ may be set to improve and/or optimize the performance of the buck converter at different drive current levels.

Figure 5:
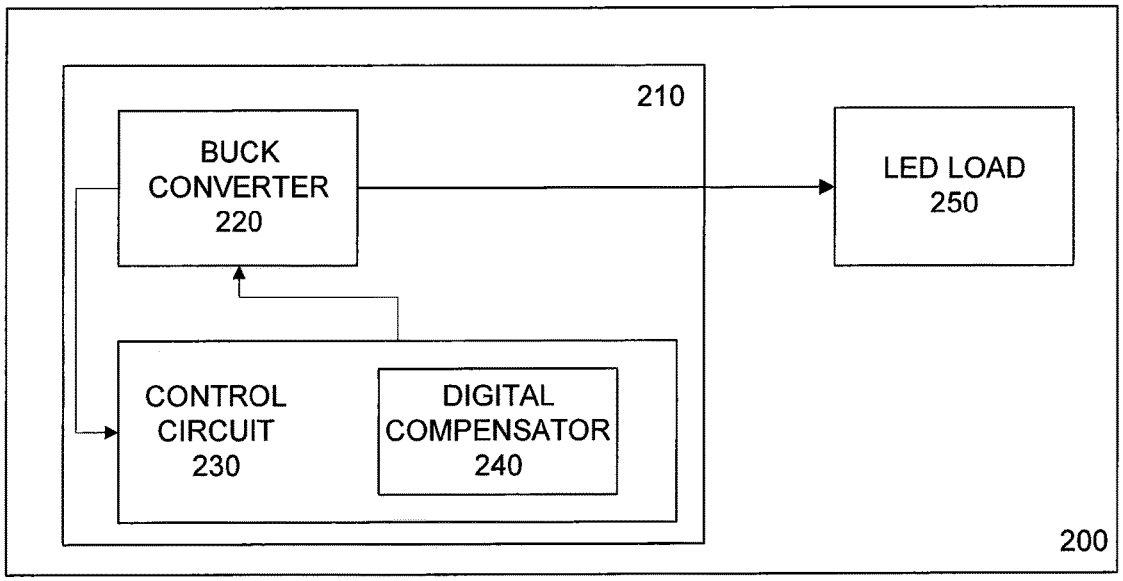
FIG. 5 is a schematic block diagram of a dimmable solid state light fixture according to embodiments of the present invention.

FIG. 5 is a schematic block diagram of a dimmable solid state light fixture 200 according to embodiments of the present invention. As shown in FIG. 5, the dimmable solid state light fixture 200 includes a driver circuit 210 and an LED load 250. The driver circuit 10 of FIG. 1B is possible implementation of the driver circuit 210. The LED load 250 may comprise, for example, one or more LEDs (not shown). When multiple LEDs are provided, the LEDs may be arranged in series or in parallel or a combination thereof.

As shown in FIG. 5, the driver circuit 210 includes a DC-to-DC buck converter 220 that is configured to adjust the level of the drive current that is supplied to the LED load 250 in response to a dimming control signal in order to dim the light output by the LED load 250. The drive circuit 210 further includes a control circuit 230 that is configured to operate the DC-to-DC buck converter 220 in both a continuous conduction mode of operation and a discontinuous conduction mode of operation. In some embodiments, the control circuit 230 may include a digital compensator 240. The digital compensator 240 may be configured to apply gain coefficients to an error signal that is proportional to the drive current that is supplied to the LED load 250. A first set of gain coefficients may be applied by the digital compensator 240 when the drive current is in a first range and a second set of gain coefficients may be applied by the digital compensator 240 when the drive current is in a second range. Moreover, more than two sets of gain coefficients may be used. The first set of gain coefficients may be used when the buck converter 220 is operating in a continuous conduction mode of operation at a drive current level above a first value $A_1$, and the second set of gain coefficients may be used when the buck converter 220 is operating in the continuous conduction mode of operation at a drive current level at or below the first value $A_1$, and may also be used for at least some range of drive current values when the buck converter 220 is operating in the discontinuous conduction mode of operation. A third set of gain coefficients may be used when the buck converter 220 is operating in the discontinuous conduction mode of operation at very low current levels, and a fourth set of gain coefficients may be used in some embodiments when the buck converter 220 is operating in the continuous conduction mode of operation at high drive current levels. More or less sets of gain coefficients may be used in other embodiments.

Figure 6:
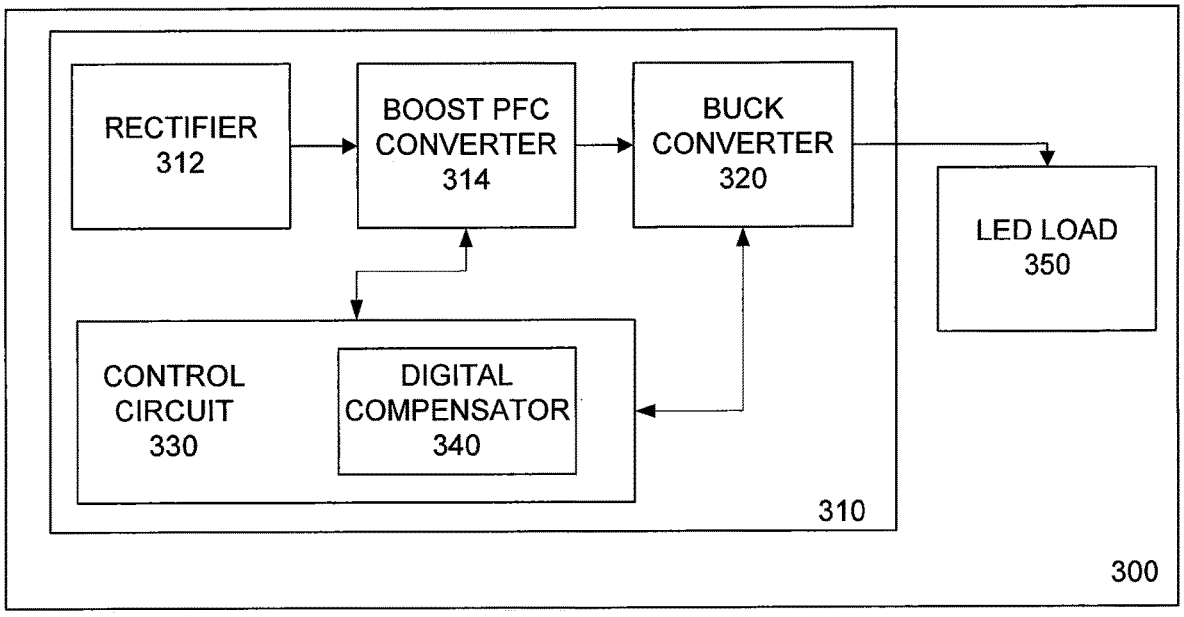
FIG. 6 is a schematic block diagram of a dimmable solid state light fixture according to further embodiments of the present invention.

FIG. 6 is a schematic block diagram of a dimmable solid state light fixture 300 according to embodiments of the present invention. As shown in FIG. 6, the dimmable solid state light fixture 300 includes an LED load 350 and a driver circuit 310 that supplies a drive current to the LED load 350. The driver circuit 10 of FIG. 1B is possible implementation of the driver circuit 310. The LED load 350 may comprise, for example, one or more LEDs (not shown). When multiple LEDs are provided, the LEDs may be arranged in series or in parallel or a combination thereof.

As shown in FIG. 6, the driver circuit 310 includes a rectifier 312, a boost PFC converter 314, a buck converter 320 and a control circuit 330. The rectifier 312 may receive an AC voltage from an external source and may rectify this AC voltage. Any suitable rectifier circuit may be used to implement rectifier 312. The boost PFC converter 314 may receive the rectified voltage output by the rectifier 312 and may increase the voltage thereof. The boost PFC converter 314 may operate under the control of the control circuit 330. The boost PFC converter 314 may also provide power factor correction in some embodiments. The buck converter 320 may also operate under the control of the control circuit 330 to regulate the drive current supplied to the LED load 350.

The buck converter 320 may be configured to adjust the drive current that is supplied to the LED load 350 in response to a dimming control signal in order to dim the light output by the LED load 350. The control circuit 330 may include a digital compensator 340. The digital compensator 340 may be configured to apply gain coefficients to an error signal that is proportional to the drive current that is supplied to the LED load 350. The digital compensator 340 may be configured to apply a first set of gain coefficients to the error signal when the drive current is in a first range and a second set of gain coefficients when the drive current is in a second range.

Figure 7:
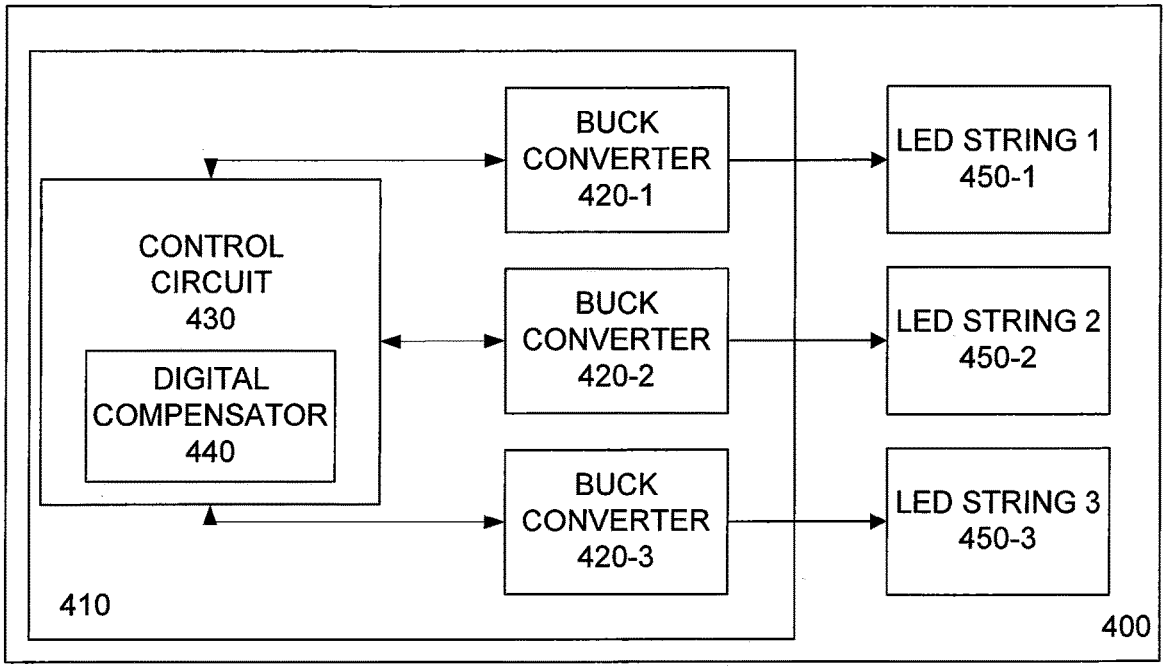
FIG. 7 is a schematic block diagram of a dimmable solid state light fixture according to still further embodiments of the present invention.

In some embodiments, the solid state light fixtures may have multiple strings of LED packages. In some embodiments where multiple strings of LED packages are provided, the driver circuit may include a current supply module controller for each LED string. FIG. 7 is a schematic block diagram of such a solid state light fixture 400. As shown in FIG. 7, the solid state light fixture 400 includes three LED strings 450-1, 450-2, 450-3. The driver circuit 410 includes three buck converters 420-1, 420-2, 420-3 that supply drive currents to the respective LED loads 450-1, 450-2, 450-3. A single buck controller 430 may be provided that controls each of the buck converters 450-1, 450-2, 450-3. In other embodiments, each buck converter 450-1, 450-2, 450-3 may have its own associated buck controller 430.

As discussed above with reference to FIG. 2, in some embodiments of the present invention, a differential current sense amplifier 80 (or other appropriate type of amplifier) may be used to amplify a sensed voltage that is proportional to the drive current flowing through the LED load 20, and the amplified signal is fed to the analog-to-digital converter 84. In such embodiments, it may be important for proper operation of the driver circuit that the amplified signal is accurate. However, various inaccuracies may be present in the drive current sensing circuitry due, for example, to characteristics of the various components thereof. One such source of error may be various offsets in the differential current sense amplifier 80 such as, for example, the sense amplifier input offset voltage, the sense amplifier offset power supply voltage and/or the sense amplifier reference voltage rejection ratio. Another source of error may be the input offset in the analog-to-digital converter 84.

Pursuant to embodiments of the present invention, the above-referenced potential sources of error in the drive current sensing circuitry may be "calibrated out" by using a firmware command to turn off the buck converter 60 (or other current supply module) so that no drive current is flowing through the LED load 20, which means that there is no voltage drop across the sense resistor 66. The voltage value at the output of the analog-to-digital converter 84 may be read, and this value may likewise represent the voltage offset that is present in the current sensing circuitry (e.g., the sense amplifier 80, the sense resistor 66 and the analog-to-digital converter 84). The measured/read value, which represents the "zero offset" for the current sensing circuitry, may be recorded as, for example, a current value (or any other appropriate value) and then used to adjust the actual value at the output of the analog-to-digital converter 84 during normal operation of the driver circuit. In this fashion, the offsets in the current sensing circuitry may be identified and corrected for to improve the accuracy of the current sensing circuitry.

It should also be noted that characteristics of components may vary over time due to aging effects or the effect of heat, current flow or the like on the components. Thus, the zero offset may change over time. As the method for calibrating the zero offset may be performed by firmware in the buck controller 16, the driver circuit 10 can be further programmed to rerun the calibration operations that are used to determine the zero offset at predefined intervals, under pre-defined conditions or the like. In this fashion, the zero offset may be periodically re-determined in order to reduce the amount of error in the current sensing circuitry, thereby providing for more consistent and accurate operation of the driver circuit 10.

Figure 8A:
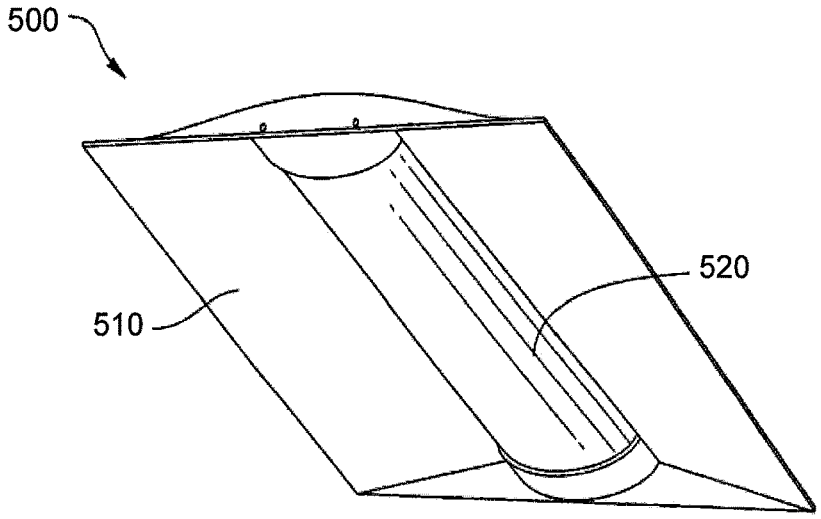
FIG. 8A is a perspective view of a tunable troffer light fixture according to embodiments of the present invention.
Figure 8B:
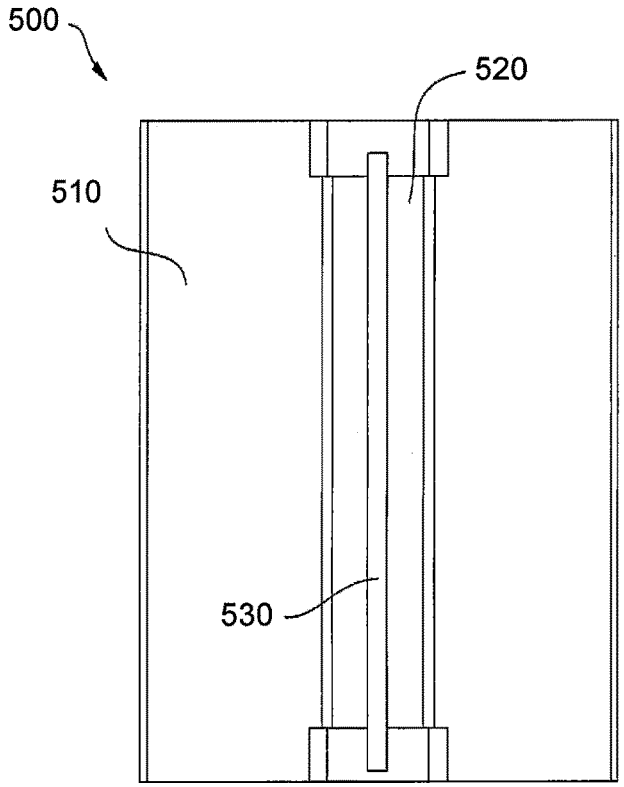
FIG. 8B is a plan view of the tunable troffer light fixture of FIG. 8A.
Figure 8C:
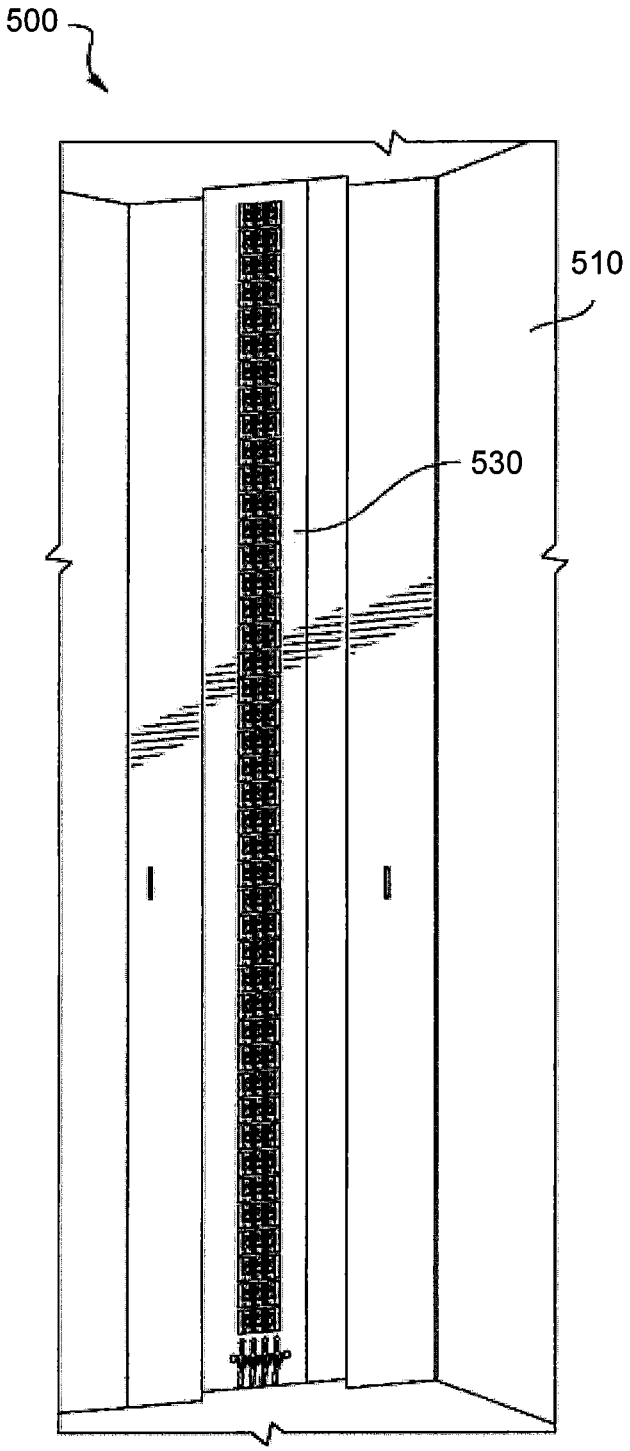
FIG. 8C is a perspective view of the tunable troffer light fixture of FIG. 8A.
Figure 8D:
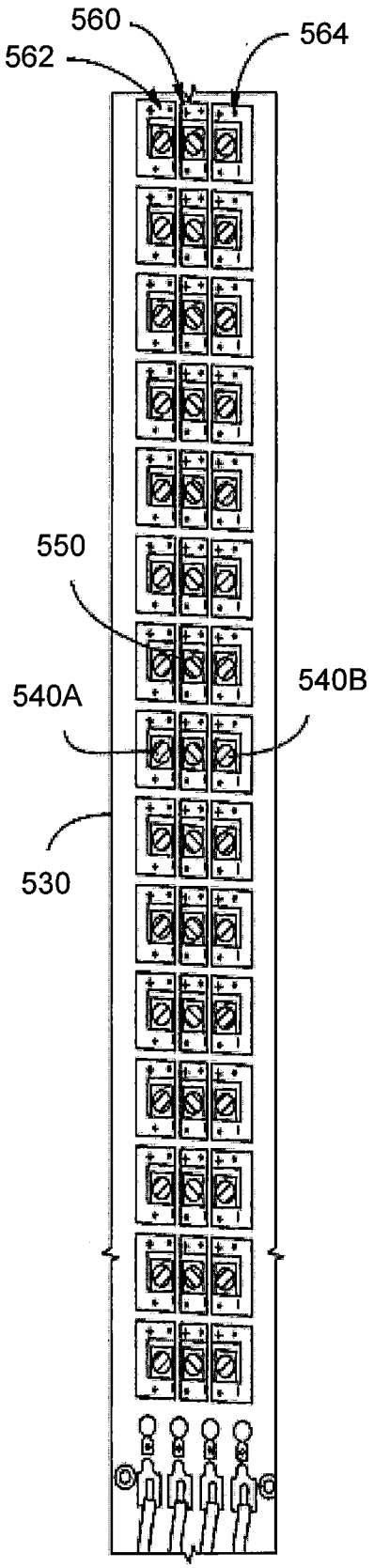
FIG. 8D is an enlarged view of a portion of the LED package mounting surface and LED packages of the tunable troffer light fixture of FIG. 8A.

FIGS. 8A-8D illustrate a troffer light fixture 500 according to embodiments of the present invention. In particular, FIG. 8A is a perspective view of the troffer light fixture 500, FIG. 8B is a schematic plan view of the troffer light fixture 500 with a dome thereof removed, FIG. 8C is a perspective view of a portion of the troffer light fixture 500 that illustrates the LED package mounting structure and the LED packages included in the troffer light fixture 500, and FIG. 8D is an enlarged view of a portion of a printed circuit board of the tunable troffer light fixture 800 that acts as the LED package mounting structure. The light fixture 500 may be an adjustable light fixture that may be "tuned" to operate over a range of color points and/or correlated color temperatures. In some embodiments, the light fixture 500 may include at least three separately controllable strings of LED packages (referred to herein as "LED strings") and at least three different types of LED packages. The correlated color temperature/color point of the light emitted by these light fixtures may be adjusted by adjusting the relative amounts of current supplied to each of the three strings of LED packages.

The LED packages may comprise LEDs that have an associated recipient luminophoric medium such that the combination of the LED and the recipient luminophoric medium emits light having a certain color point. As discussed above, a "blue-shifted-yellow/green LED package" refers to an LED that emits light in the blue color range that has an associated recipient luminophoric medium that includes phosphor(s) that receive the blue light emitted by the blue LED and in response thereto emit light having a peak wavelength in either the yellow color range or the green color range. For purposes of this disclosure, the various color ranges of visible light are defined as shown in TABLE 1 below. A common example of a blue-shifted-yellow/green LED package is a GaN-based blue LED that is coated or sprayed with a recipient luminophoric medium that includes a YAG:Ce and/or a LuAG:Ce phosphor. A "blue-shifted-red LED package" refers to an LED that emits light in the blue color range that has an associated recipient luminophoric medium that includes phosphor(s) that receive the blue light emitted by the blue LED and in response thereto emit light having a peak wavelength in the red color range.

TABLE 1

| Color | Wavelength Range (nm) |
|---|---|
| Blue | 430-479 |
| Cyan | 480-510 |
| Green | 511-549 |
| Yellow | 550-580 |
| Orange | 581-604 |
| Red | 605-700 |

Thus, for example, the recipient luminophoric medium of a blue-shifted-yellow/green LED package will emit light having a peak wavelength in the 511-580 nm range.

As shown in FIG. 8A, the troffer light fixture 500 includes a backplate 510 and a dome 520. The dome 520 may or may not also function as a diffuser that mixes light emitted by the LED packages (described below). As shown in FIG. 8B, a printed circuit board 530 or other LED package mounting structure may be mounted on the backplate 510 underneath the dome 520.

Turning now to FIGS. 8C-8D, the printed circuit board 530 may be mounted on the backplate 510 behind the dome/diffuser 520. A plurality of blue-shifted-yellow/green LED packages 540 and a plurality of blue-shifted-red LED packages 550 are mounted in three rows on the printed circuit board 530.

As shown in FIG. 8D, the blue-shifted-yellow/green LED packages 540 and the blue-shifted-red LED packages 550 may be arranged in three generally parallel, spaced-apart rows 560, 562, 564. The blue-shifted-yellow/green LED packages 540 may be in the two outside rows 562, 564, and the blue-shifted-red LED packages 550 may be in the middle row 560 that is between the two outside rows 562, 564. In some embodiments, the LED packages 540 in the second row 562 may comprise blue-shifted-yellow/green LED packages 540A and the LED packages 540 in the third row 564 may comprise blue-shifted-yellow/green LED packages 540B, where the blue-shifted-yellow/green LED packages 540A are designed to emit different color light than the blue-shifted-yellow/green LED packages 540B.

In one example embodiment, the troffer light fixture 500 includes 180 LED packages (i.e., 60 LED packages per row). The LED packages 540A, 540B, 550 may be electrically connected in a plurality of LED strings. In an example embodiment, each of the three rows 560, 562, 564 may include five strings of twelve adjacent LED packages each, with the LED packages in each string electrically connected, for example, in series. In this embodiment, five strings of LED packages 540A, five strings of LED packages 540B, and five strings of LED packages 550 are included in the light fixture 500. A separate buck controller (or other current supply module) may be provided for each LED string 540A, 540B, 550 to supply and regulate the drive current provided to the respective LED strings. 540A, 540B, 550.

In some embodiments, the LED packages 540A in the second row 562 may include the same phosphor as the LED packages 540B in the third row 564, but may have a different amount of phosphor. In particular, the LED packages 540A may have a higher amount of phosphor than the LED packages 540B. As a result, the LED packages 540A and 540B will emit light having different color points. The color point of the light emitted by the troffer light fixture 500 may be changed by varying the currents provided to the respective different types of LED packages 540A, 540B, 550. The phosphor(s) included in the LED packages 540A, 540B may, for example, be a LuAG:Ce phosphor, a YAG:Ce phosphor, or a combination of YAG:Ce phosphor and a LuAG:Ce phosphor. Other phosphors may also be used. In some embodiments, each LED package 540A, 540B may include a single type of phosphor (e.g., a LuAG:Ce phosphor), and the LED packages 540A may have more of this phosphor than the LED packages 540B. The LED packages 540A may be referred to herein as "high phosphor" LED packages as they may include a greater amount of phosphor than the "low phosphor" LED packages 540B. Because the same phosphor is used any change in the performance of the phosphor over time and/or with temperature will tend to be the same for the LED packages 540A and 540B. This may lessen the impact of such changes on the light output by the light fixture 500. The red phosphor included in the blue-shifted-red LED packages 550 may be, for example, a $(Ca_{1-x}Sr_x)SiAlN_3:Eu^{2+}$ phosphor in some embodiments.

Figure 8E:
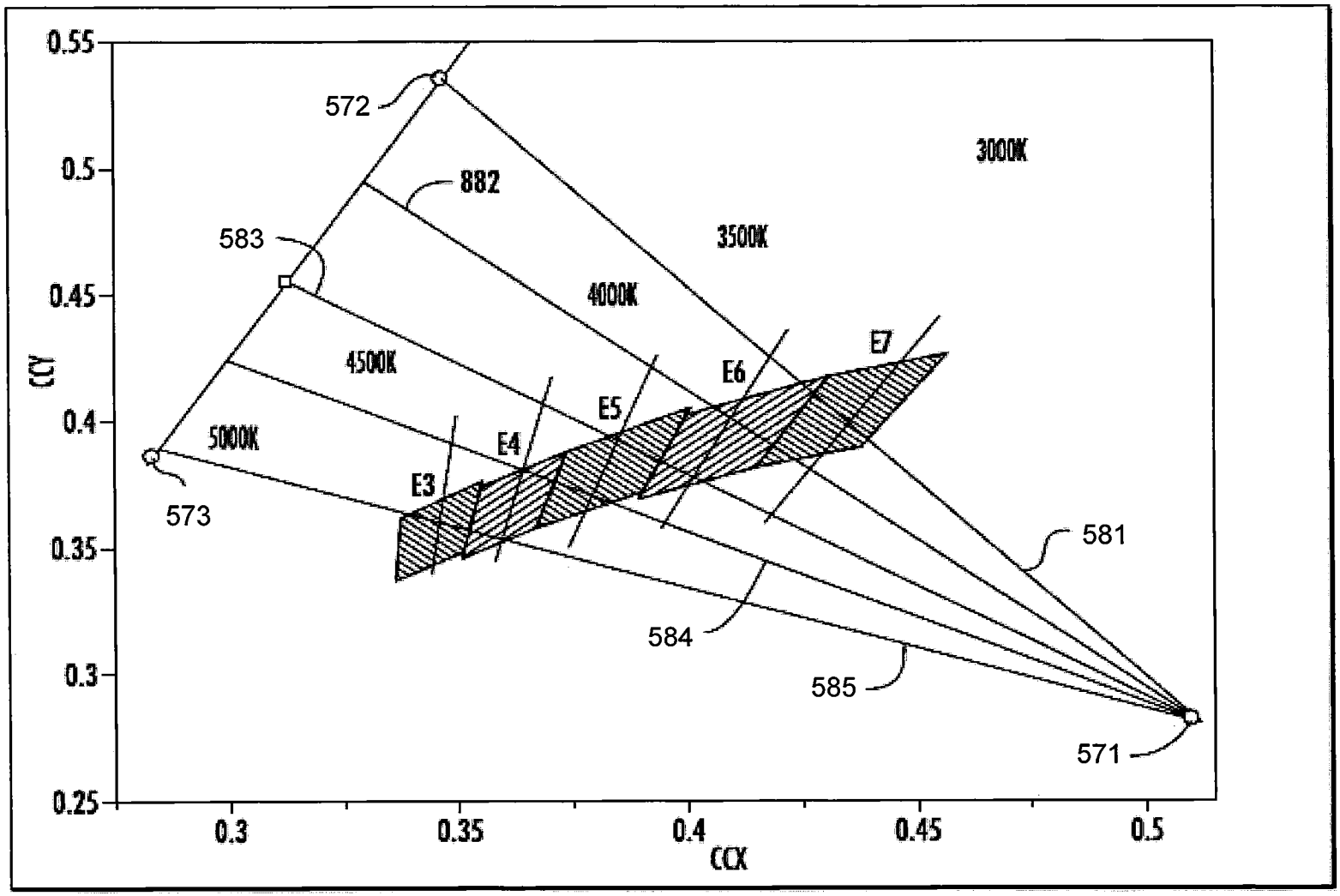
FIG. 8E is an enlarged portion of the 1931 CIE Chromaticity Diagram illustrating a range of color points that may be achieved using the tunable troffer light fixture of FIG. 8A.

FIG. 8E is an enlarged portion of the 1931 CIE Chromaticity Diagram that illustrates a range of color points that may be achieved using the tunable troffer light fixture 500. The 1931 CIE Chromaticity Diagram is discussed at length in the aforementioned U.S. patent application Ser. No. 15/226,992. As shown in FIG. 8E, in some embodiments, the color point 571 of the light emitted by the blue-shifted-red LED packages 550 may be selected to form a tie line 581 with the color point 572 of the blue-shifted-yellow/green LED packages 540A that runs through the E7 bin on the 1931 CIE Chromaticity Diagram. This may be seen graphically in FIG. 8E, where the tie line 581 that connects the color point 571 for the LED packages 550 to the color point 572 for the LED packages 540A runs through the E7 color bin. Likewise, the color point 573 of the light emitted by the blue-shifted-yellow/green LED packages 540B may be selected to form a tie line 585 with the color point 571 of the LED packages 550 that runs through the E3 bin on the 1931 CIE Chromaticity Diagram. Additional tie lines 582-584 are illustrated in FIG. 8E which extend from the color point 571 for the LED packages 550 to points on a line that extends between color points 572 and 573. The tie lines 582-584 extend through the E4, E5 and E6 color bins on the 1931 CIE Chromaticity Diagram, respectively. Thus, it can be seen that by varying the relative levels of the currents supplied to the three rows of LED packages 560, 562, 564, the troffer light fixture 500 may be configured to emit light having a color point in any of the E3 through E7 color bins. In principle, any color point that is within the triangle formed by the three anchor points 571-573 can be reached with a given combination of currents for the three strings of LED packages—although points on the black body locus may be of principal interest for applications.

Referring again to FIG. 8D, in some embodiments, the first through third rows 560, 562, 564 of LED packages may comprise a first middle row 560 of LED packages 550, a second outside row 562 of LED packages 540A, and a third outside row 564 of LED packages 540B. The first row 560 of LED packages 550 is between the second and third rows 562, 564. The three rows 560, 562, 564 may be spaced apart and generally parallel to each other. The LED packages 540A, 540B, 550 may also be aligned in columns of three LED packages each as shown, although they need not be in some embodiments. In order to operate the tunable troffer light fixture 500 in the E3 color bin (correlated color temperature (CCT) of about 5000 K), a relatively high current may be provided to the LED string(s) in the third row 564 (i.e., to the low phosphor LED packages 540B) while little or no current is supplied to the LED strings in the second row 562 (i.e., to the high phosphor LED packages 540A), and relatively less current is supplied to the LED packages 550 included in the first (middle) row 560. In order to operate the tunable troffer light fixture 500 in the E7 color bin (CCT of about 3000 K), a relatively high current may be provided to the LED string(s) in the second row 562 (i.e., to the high phosphor LED packages 540A) while little or no current is supplied to the LED strings in the third row 564 (i.e., to the low phosphor LED packages 540B), and relatively more current is supplied to the LED packages 550 included in the first (middle) row 560.

As described above, example solid state light fixtures according to embodiments of the present invention may include multiple LED strings with each LED string including various types of LED packages. In the example light fixture discussed above with reference to FIGS. 8A-D, each LED string includes either blue-shifted-yellow/green LED packages 540 or blue-shifted-red LED packages 550. These LED packages may all be made using the same type of blue light emitting LED such as, for example, a gallium nitride based blue light emitting LED. As a result, the blue LEDs will tend to act the same with respect to changes in temperature and with respect to aging of the LEDs over time. Consequently, the control circuitry that is included in many conventional solid state light fixtures that adjusts for differences in how the light output of red LEDs varies from the light output phosphor-converted blue LEDs as a function of temperature and/or aging may be omitted.

However, since variable-current dimming is used in solid state light fixtures according to embodiments of the present invention, it has been discovered that the color point of the light emitted by the various LED packages may change during dimming. In particular, as the level of the drive current is reduced, small changes may occur in both the peak wavelength of the light emitted by the blue LEDs and changes may also occur in the spectra of the light output by the blue LEDs (e.g., the full width half maximum value of the spectral power distribution of the blue LEDs may change). The changes in the light emitted by the LEDs also impacts the color point of the light emitted by the phosphors, as the emission of a phosphor is dependent on the characteristics of the received light that excites the emission. These changes may cause the color point of the light emitted by the LED packages, and hence the light emitted by the solid state light fixture, to change during dimming operations. Such changes generally do not arise when pulse width modulation dimming techniques are used since the current level does not change (only the duty cycle).

Pursuant to further embodiments of the present invention, driver circuits for solid state light fixtures are provided that may be configured to non-proportionally adjust the drive current supplied to at least one of a plurality of LED strings included in the light fixture during dimming in order to compensate for changes in the color point that occur as the drive current supplied to the LED strings is reduced during dimming.

In some embodiments, an empirical solution may be used to determine the adjustment(s) that are made to maintain the overall color point of the light fixture during dimming. As an example, the solid state light fixture may be dimmed in increments of 5% from 100% brightness to 5% brightness and the color point may be measured at each of these brightness levels. The drive currents supplied to one or more of the LED strings may then be adjusted while measuring the color point until the drive current level(s) for the LED strings are determined that will maintain the color point of the light fixture at each of these dimming levels.

While the drive current levels to more than one LED string may be adjusted to maintain the color point at a particular level, in practice it may be easier to adjust the drive current on a single LED string (or on a single type of LED string). If, for example, the light fixture includes one or more stings of blue-shifted-red LED packages, the drive current(s) to the strings of blue-shifted-red LED packages may be adjusted as the solid state light fixture is dimmed by increments of 5% to determine the change in the drive current necessary to maintain the color point at a pre-selected level during diming operations. These adjustments to the drive current may then be programmed into a control circuit that sets the drive current for the LED string so that the control circuit can adjust the drive current to the LED string as necessary during dimming to maintain the color point of the light emitted by the solid state light fixture during dimming. The drive current to the string(s) of blue-shifted-red LED packages may be selected for adjustment as they may provide the largest change in color point variation for the least amount of change in the drive current.

As discussed above, in some embodiments, the solid state light fixture may emit light having a pre-selected (and adjustable) color point. For example, as described above, the light emitted by the solid state light fixture 500 may have a color point that can be "tuned" from anywhere between 3500 K and 5000 K by adjusting the drive circuits supplied to the three different types of LED strings. In some embodiments, an empirical solution for maintaining the color point of the light emitted by the solid state light fixture during dimming may be determined for a plurality of different color points that the solid state light fixture may be "set" at. As one simple example, the solid state light fixture 500 may be set to emit light having a correlated color temperature of any one of 3500 K, 4000 K, 4500 K or 5000 K, where the emitted light is on or near the black body locus.

For each of these color temperature settings for the light fixture 500, the light fixture may be dimmed to, for example, 5% brightness (by lowering the drive currents for each LED string to 5% of their non-dimmed values) and the color point of the resulting light may be measured. For each color point, the drive current to the blue-shifted-red LED strings may then be adjusted in small increments until it is determined that the color point of the light emitted by the solid state light fixture has been restored to the same point as when the solid state light fixture is not dimmed. In some embodiments, a linear fit may be assumed and thus it may only be necessary to determine the adjustment to the drive current necessary to return the color point to a desired value and this linear fit may be used to calculate the adjustments for all other levels of dimming at a given color point.

In some embodiments, the disproportionate adjustment to the drive current supplied to the blue-shifted-red LED strings that is applied during dimming (or perhaps only during deep dimming) may be a further reduction of the drive current supplied to the blue-shifted-red LED strings (i.e., the drive current to the blue-shifted-red LED strings is reduced proportionally more than the drive currents to the blue-shifted-yellow/green LED strings). Such an adjustment may be appropriate for solid state light fixtures that are configured to operate at relatively low correlated color temperatures (e.g., less than 4000 K) that are at or near the black body locus. In other embodiments, the disproportionate adjustment to the drive current supplied to the blue-shifted-red LED strings that is applied during dimming (or perhaps only during deep dimming) may be to decrease the drive current supplied to the blue-shifted-red LED strings proportionally less than the drive currents to the blue-shifted-yellow/green LED strings. Such an adjustment may be appropriate for solid state light fixtures that are configured to operate at relatively high correlated color temperatures (e.g., above 4000 K) that are at or near the black body locus.

While FIGS. 8A-8D illustrate one example solid state light fixture that may incorporate the various drive circuits disclosed herein, it will be appreciated that the driver circuits disclosed herein may be used with a wide variety of different solid state light fixtures. As just one example of this, the aforementioned U.S. patent application Ser. No. 15/226,992 discloses a wide variety of solid state light fixtures, and the driver circuits disclosed herein may be used with any of those light fixtures, suitably modified to account for different numbers of LED strings and the like.

Figure 9:
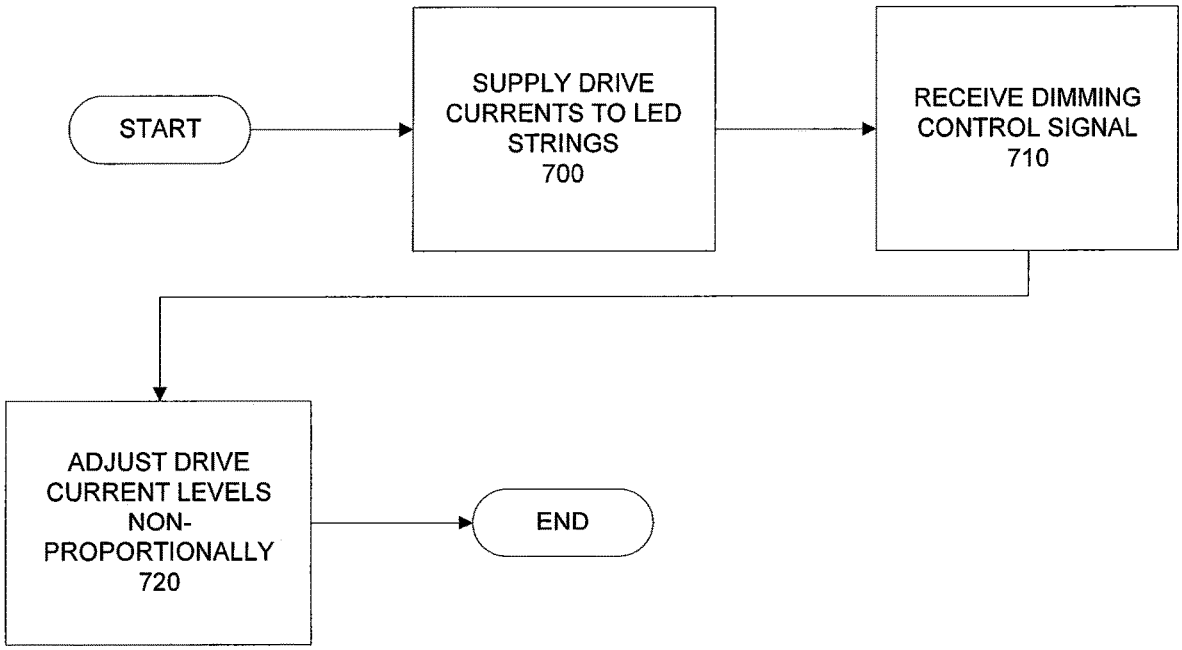
FIG. 9 is a flow chart illustrating a method of dimming a solid state light fixture according to embodiments of the present invention.

FIG. 9 is a flow chart illustrating a method of dimming a solid state light fixture having a plurality of strings of LEDs according to embodiments of the present invention. As shown in FIG. 9, operations may begin with drive currents being supplied to each of a plurality of strings of LEDs (Block 700). A dimming control signal may be received from, for example, a dimming controller (Block 710). A level of respective drive currents that are supplied to each of the strings of LEDs may then be adjusted in response to the dimming control signal, where the drive current supplied to a first of the LED strings is adjusted on a percentage basis differently than the drive current supplied to a second of the LED strings to account for changes color point of the light emitted by the solid state light fixture during dimming due to changes in the peak wavelength and emission spectra of the LEDs in the strings of LEDs that arise as the level of the respective drive currents is reduced (Block 720).

The solid state light fixtures according to some embodiments of the present invention may operate over a wide range of brightness levels, from full brightness to ultra-low dimming. As a result, the average current supplied to the LED load(s) of these solid state light fixtures may vary widely (e.g., by a factor of 200 or more in some cases). For example, drive current levels may vary as much as from 1 mA to 1.5 A in some embodiments depending upon a desired level of dimming In an example embodiment, drive current levels may vary from 2.5 ma to 440 mA, which is a factor of 176.

When variable current dimming is used, the drive current levels that are supplied to the LED load(s) may thus vary widely. The drive current that is supplied to the LED load may be controlled by sensing a level of the drive current (e.g., by measuring a voltage drop over a resistor that is connected in series with the LED load), comparing it to a reference value, and then generating an error signal that represents the difference between the sensed drive current level and the reference value. This error signal may then be amplified, converted to a digital signal, and input to a compensator. The compensator may be used to selectively filter out some components while amplifying others, of the feedback error signal, in order to ensure that the converter works within design margins. Gain coefficients for the compensator may be set that perform the selective filtering and amplification of components of the digitized error signal.

Because of the wide range of current levels that may result when variable current dimming is used with a solid state light fixture that may be dimmed to low levels, the current supply module may, for example, operate in different modes. For example, if the current supply module is implemented as a buck converter or a boost converter, the converter may operate in continuous conduction mode when the light fixture is not dimmed or dimmed to moderate levels, but may operate in the discontinuous conduction mode when the light fixture is heavily dimmed. The transfer functions of the converter may change significantly when transitioning from continuous conduction mode to discontinuous conduction mode. As such, the gain coefficients that are suitable for filtering/amplifying the error signal when the converter operates in the continuous conduction mode of operation may not be suitable when the converter operates in the discontinuous conduction mode of operation. Accordingly, pursuant to embodiments of the present invention, the gain coefficients of the digital compensator may be changed based on, for example, the level of drive current supplied to the LED load (or an equivalent or similar parameter such as a value of a dimming control signal).

In one example embodiment, the gain coefficients may be changed when the drive current level is within +/−10% of the drive current level of the transition point where operation of the converter switches between continuous conduction mode and discontinuous conduction mode. For example, if this transition occurs at a drive current of 80 mA, the gain coefficients would be changed at a drive current somewhere in the range of 72-88 mA. In other embodiments, the gain coefficients may be changed when the drive current level is within +/−5% of the drive current level of the transition point. In still other embodiments, the gain coefficients may be changed when the drive current level is within +/−3% of the drive current level of the transition point. In still other embodiments, the gain coefficients may be changed when the drive current level is between the drive current level of the transition point and 1.1 times the drive current level of the transition point (i.e., if the transition point where operation shifts between continuous conduction mode and discontinuous conduction mode occurs at a drive current of 80 mA, the gain coefficients are changed at a drive current level somewhere in the range of 80 mA and 88 mA). In yet other embodiments, the gain coefficients may be changed when the drive current level is between the drive current level of the transition point and 1.05 times the drive current level of the transition point. The gain coefficients may also be changed again at a drive current level that is between 35% and 65% of the drive current level of the transition point.

The solid state light fixtures according to certain embodiments of the present invention may be capable of ultra-low dimming without flickering or shimmering. Consequently, the banding or rolling lines that may occur in images and/or videos captured by cameras when the cameras are operating with conventional solid state light fixtures operating under ultra-low dimming conditions may be avoided. Moreover, the solid state light fixtures according to embodiments of the present invention may exhibit good power efficiency and may be designed to maintain a desired color point, even during dimming operations.

It will be appreciated that a wide variety of changes may be made to the example embodiments described above without departing from the scope of the present invention. For example, in certain of the embodiments of the present invention discussed above MOSFETs are used to implement various switches in the PFC boost converter 40 and the buck converter 60. It will be appreciated that a wide variety of different elements may be used to implement these switches such as, for example, bipolar junction transistors, thyristors, insulated gate bipolar junction transistors and the like. As another example, while the driver circuits shown in the examples herein have an AC voltage source, it will be appreciated that a DC voltage source (e.g., a battery) may be used in other embodiments. In such embodiments, the rectifier may be omitted.

As another example, it will also be understood that the front end of the buck converter 60 that is included in various of the current driver circuits described herein can have any appropriate topology including, for example, a flyback, a single0ended primary inductor converter, a buck-boost or a buck topology. Likewise, the switching current regulation circuitry that is used to regulate the drive current to the LED load 20 during normal operating conditions and moderate levels of dimming can be any appropriate type of switching current regulation circuit.

It will likewise be appreciated that the solid state light fixtures according to embodiments of the present invention may include a single string of LEDs or multiple strings of LEDs. In some cases, all of the LEDs in a string may be the same type of LED, while in other cases an LED string may have two or more different types of LEDs included therein. Thus, while the example of FIGS. 8A-8E above is of a solid state light fixture that includes multiple strings of LEDs where different strings have different types of LEDs, but each individual string only includes one type of LED, it will be appreciated that embodiments of the present invention are not limited thereto. For example, in another embodiment, at least some of the LED strings included in the solid state light fixture 500 of FIGS. 8A-8D could include two or more different types of LED packages (e.g., both blue-shifted-yellow/green LED packages and blue-shifted-red LED packages). In another embodiment, the solid state light fixture could be modified to only have strings of LEDs that include one type of LED package.

Figure 10A:
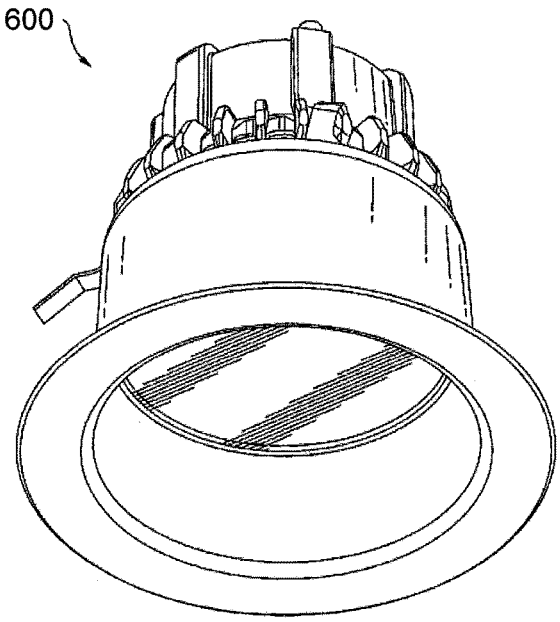
FIG. 10A illustrates a PAR-series downlight according to embodiments of the present invention.
Figure 10B:
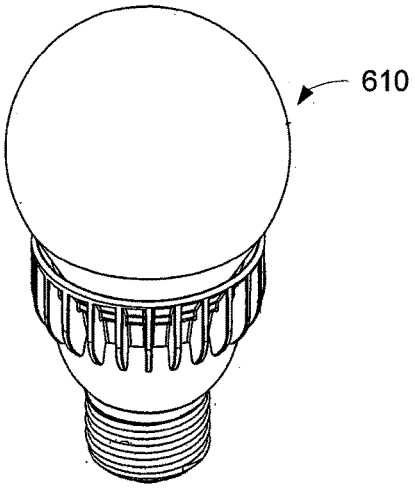
FIG. 10B illustrates a solid state light bulb according to embodiments of the present invention.
Figure 10C:
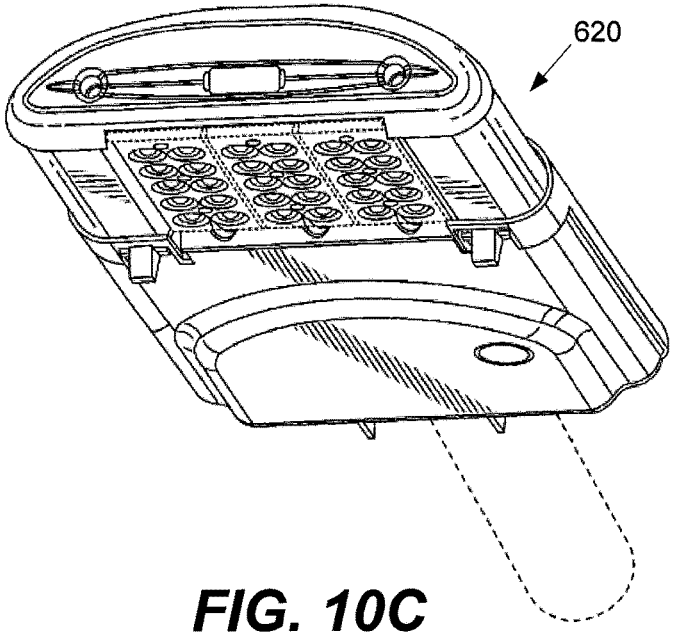
FIG. 10C illustrates a solid state streetlight according to embodiments of the present invention.

The driver circuits according to embodiments of the present invention may be incorporated into a solid state light fixture to provide a dimmable, energy efficient fixture. These driver circuits may be incorporated into a wide variety of different types of solid state light fixtures. For example, FIG. 10A illustrates a PAR-series downlight 600 that may include, for example, blue-shifted-yellow/green LED packages and blue-shifted-red LED packages and a driver circuit according to any of the above-described embodiments of the present invention. The driver circuits according to embodiments of the present invention may likewise be used in any appropriate PAR or BR series downlights such as the downlights disclosed in U.S. Pat. Nos. 8,591,062 and 8,596,819 and U.S. patent application Ser. No. 14/306,342, each of which are incorporated herein by reference. Other downlights and similar fixtures that can be implemented using the above-described blue-shifted-yellow/green LED packages and blue-shifted-red LED packages according to embodiments of the present invention include the downlights disclosed in U.S. Pat. Nos. 8,622,584; 8,425,071; 9,028,087; 8,882,311; and U.S. Patent Publication No. 2015/0253488, each of which are incorporated herein by reference. As another example, FIG. 10B illustrates a solid state light bulb 610 that may include any of the driver circuits according to embodiments of the present invention disclosed herein. As yet another example, FIG. 10C illustrates a solid state streetlight 620 that may include any of the driver circuits according to embodiments of the present invention disclosed herein. U.S. Pat. Nos. 8,622,584; 8,425,071; 9,028,087; and U.S. Patent Publication No. 2015/0253488, each of which are incorporated herein by reference, illustrate other streetlights that could include the driver circuits according to embodiments of the present invention.

The present invention is not limited to the illustrated embodiments discussed above; rather, these embodiments are intended to fully and completely disclose the invention to those skilled in this art.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

All of the above-described embodiments may be combined in any way to provide a plurality of additional embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A solid state light fixture, comprising:

a light emitting diode (LED) load; and a driver circuit that is configured to supply a drive current to the LED load, the driver circuit including a current supply module that is configured to reduce a drive current level during dimming of the solid state light fixture, wherein the current supply module is configured to operate in both a continuous conduction mode to maintain a light output by the solid state light fixture at a first dimming level and to operate in a discontinuous conduction mode to maintain the light output by the solid state light fixture at a second dimming level that has a lower light output than the first dimming level, wherein the driver circuit is configured to operate as a variable current dimming driver circuit in which a peak level of the drive current supplied to the LED load is adjusted in response to a dimming control signal, wherein the current supply module includes a switch and an inductor, wherein the switch is configured to turn on sometime after the current of the inductor decreases to zero when the current supply module operates in the discontinuous conduction mode.

2. The solid state light fixture of claim 1, wherein the driver circuit further includes a controller that includes a digital compensator.

3. The solid state light fixture of claim 1, wherein the LED load comprises a first string of LEDs and the current supply module comprises a first current supply module, the solid state light fixture further comprising a second string of LEDs and the driver circuit further includes a second current supply module that is configured to supply a second drive current to the second string of LEDs, and wherein the drive current supplied to the first string of LEDs is reduced by a different percentage than the second drive current supplied to the second string of LEDs during dimming to substantially maintain a color point of the light emitted by the solid state light fixture during the dimming.

4. The solid state light fixture of claim 3, the solid state light fixture further comprising a third string of LEDs and the driver circuit further includes a third current supply module that is configured to supply a third drive current to the third string of LEDs, wherein the third drive current supplied to the third string of LEDs is reduced by the same percentage as is the second drive current supplied to the second string of LEDs during dimming.

5. The solid state light fixture of claim 4, wherein the first string of LEDs comprises a string of blue-shifted-red LEDs.

6. The solid state light fixture of claim 1, wherein the LED load comprises a string of blue-shifted-red LED packages, wherein the solid state light fixture further includes a plurality of blue-shifted-yellow/green LED packages, the blue-shifted-yellow/green LED packages including low-phosphor LED packages and high phosphor LED packages, the high phosphor LED packages having a higher phosphor conversion ratio than the low phosphor LED packages, and wherein the blue-shifted-red LED packages extend in a first row and a first subset of the blue-shifted-yellow/green LED packages extend in a second row on a first side of the blue-shifted-red LED packages and a second subset of the blue-shifted-yellow/green LED packages extend in a third row on a second side of the blue-shifted-red LED packages that is opposite the first side.

7. The solid state light fixture of claim 1, wherein the current supply module comprises a buck converter.

8. The solid state light fixture of claim 1, wherein the driver circuit is further configured to apply an offset that adjusts the drive current to account for errors in a sensed level of the drive current.

9. The solid state light fixture of claim 1, wherein the inductor is positioned between the LED load and the switch, and the switch is configured to turn on and off in response to an error signal.

10. A solid state light fixture, comprising:

a light emitting diode (LED) load; and a driver circuit that is configured to supply a drive current to the LED load, the driver circuit including a current supply module that is configured to reduce a drive current level during dimming of the solid state light fixture, wherein the current supply module is configured to operate in both a continuous conduction mode at a first dimming level and a discontinuous conduction mode at a second dimming level that has a lower light output than the first dimming level, the driver circuit further including a controller that includes a digital compensator, wherein the digital compensator is configured to apply gain coefficients to an error signal that is indicative of a difference in the drive current level from a reference drive current level.

11. The solid state light fixture of claim 10, wherein the digital compensator is configured to apply a first set of gain coefficients when operating at a first operating condition and to apply a second set of gain coefficients when operating at a second operating condition.

12. The solid state light fixture of claim 11, wherein the first set of gain coefficients are used for at least some drive current levels where the current supply module operates in the continuous conduction mode and the second set of gain coefficients are used for at least some drive current levels where the current supply module operates in the discontinuous conduction mode.

13. The solid state light fixture of claim 11, wherein the first set of gain coefficients is used for at least some drive current levels where the current supply module operates in the continuous conduction mode and for at least some drive current levels where the current supply module operates in the discontinuous conduction mode, wherein the second set of gain coefficients is used for drive current levels where the current supply module operates in the discontinuous conduction mode that are lower than the drive current levels where the first set of gain coefficients are used.

14. A solid state light fixture, comprising:

a light emitting diode (LED) load; and a driver circuit that is configured to supply a drive current to the LED load, the driver circuit including:

a current supply module that is configured to reduce a level of the drive current during dimming of the solid state light fixture; and a controller that controls operation of the current supply module, the controller including a digital compensator that is configured to apply gain coefficients to an error signal that represents a difference in the level of the drive current from a reference drive current level;

wherein the controller is configured to use a first set of gain coefficients when operating at a first operating condition and to use a second set of gain coefficients when operating at a second operating condition.

15. The solid state light fixture of claim 14, wherein the current supply module is configured to operate in both a continuous conduction mode at a first dimming level and a discontinuous conduction mode at a second dimming level that has a lower light output than the first dimming level.

16. The solid state light fixture of claim 14, wherein the first set of gain coefficients is used for at least some drive current levels where the current supply module operates in the continuous conduction mode and the second set of gain coefficients is used for at least some operating current levels where the current supply module operates in the discontinuous conduction mode.

17. The solid state light fixture of claim 16, wherein the first set of gain coefficients is used for at least some drive current levels where the current supply module operates in the continuous conduction mode and for at least some drive current levels where the current supply module operates in the discontinuous conduction mode, and wherein the second set of gain coefficients is used for drive current levels where the current supply module operates in the discontinuous conduction mode that are lower than the drive current levels where the first set of gain coefficients are used.

18. The solid state light fixture of claim 16, wherein at least one gain coefficient in the second set of gain coefficients is larger than a corresponding gain coefficient in the first set of gain coefficients.

19. The solid state light fixture of claim 14, wherein the driver circuit is further configured to apply an offset that adjusts the drive current to account for errors in a sensed level of the drive current.

20. The solid state light fixture of claim 14, wherein the LED load comprises a first string of LEDs and the current supply module comprises a first current supply module, the solid state light fixture further comprising a second string of LEDs and the driver circuit further includes a second current supply module that is configured to supply a second drive current to the second string of LEDs, and wherein the drive current supplied to the first string of LEDs is reduced by a different percentage than the second drive current supplied to the second string of LEDs during dimming to substantially maintain a color point of the light emitted by the solid state light fixture during the dimming.

21. The solid state light fixture of claim 14, wherein the current supply module is a buck converter or a boost converter.

* * * * *